US010410810B2

(12) United States Patent
Rota Martir et al.

(10) Patent No.: US 10,410,810 B2
(45) Date of Patent: Sep. 10, 2019

(54) SWITCHING DEVICE FOR LV ELECTRIC INSTALLATIONS

(71) Applicant: ABB S.p.A., Milan (IT)

(72) Inventors: Roberto Rota Martir, Brembate Sopra (IT); Mauro Ghislotti, Bergamo (IT)

(73) Assignee: ABB S.P.A., Milan (IT)

( * ) Notice: Subject to any disclaimer, the term of this patent is extended or adjusted under 35 U.S.C. 154(b) by 0 days.

(21) Appl. No.: 15/427,907

(22) Filed: Feb. 8, 2017

(65) Prior Publication Data

US 2017/0229261 A1 Aug. 10, 2017

(30) Foreign Application Priority Data

Feb. 10, 2016 (EP) ..... 16155048

(51) Int. Cl.
*H01H 9/00* (2006.01)
*H01H 21/22* (2006.01)

(52) U.S. Cl.
CPC ..... *H01H 21/22* (2013.01)

(58) Field of Classification Search
CPC ..... H01H 21/22; H01H 21/36; H01H 21/40; H01H 5/04; H01H 71/04; H01H 71/12; H01H 71/52; H01H 71/128; H01H 71/528
USPC ..... 335/172
See application file for complete search history.

(56) References Cited

U.S. PATENT DOCUMENTS 3,517,356 A * 6/1970 Tutomu ..... H01H 73/045 335/16
4,220,934 A * 9/1980 Wafer ..... H01H 50/16 200/288
4,255,732 A * 3/1981 Wafer ..... H01H 71/2418 335/16
4,259,651 A * 3/1981 Yamat ..... H01H 77/104 335/16

(Continued)

FOREIGN PATENT DOCUMENTS

EP 0798755 A2 1/1997
EP 2382645 B1 11/2014
FR 2585179 A1 1/1987

OTHER PUBLICATIONS

European Search Report, EP16155048.8, ABB S.p.A., Jul. 21, 2016, 7 pages.

(Continued)

*Primary Examiner* — Shawki S Ismail
*Assistant Examiner* — Lisa N Homza
(74) *Attorney, Agent, or Firm* — Taft Stettinius & Hollister; J. Bruce Schelkopf

(57) ABSTRACT

A switching device for LV electric installations is disclosed which can include an outer casing and one or more electric poles. Each electric pole can include one or more mobile contacts and one or more fixed contacts adapted to be coupled or uncoupled. A mobile contact assembly is operatively coupled with the mobile contacts such that the mobile contacts move together with the mobile contact assembly. The mobile contact assembly is adapted to reversibly move between a first contact position, in which the movable contacts and the fixed contacts are coupled and a second contact position, in which the movable contacts and the fixed contacts are uncoupled. A mechanical control assembly is provided for operating said mobile contact assembly.

13 Claims, 15 Drawing Sheets

(56) References Cited

U.S. PATENT DOCUMENTS 4,263,492 A * 4/1981 Maier ..... H01H 71/504 200/288
4,649,247 A * 3/1987 Preuss ..... H01H 1/205 200/244
4,910,485 A * 3/1990 Bolongeat-Mobleu ..... H01H 1/205 200/244
5,029,301 A * 7/1991 Nebon ..... H01H 1/2041 218/146
5,103,198 A * 4/1992 Morel ..... H01H 9/50 218/149
5,140,115 A * 8/1992 Morris ..... H01H 9/16 200/308
5,184,717 A * 2/1993 Chou ..... H01H 71/501 200/327
5,281,776 A * 1/1994 Morel ..... H01H 1/2058 218/152
5,296,660 A * 3/1994 Morel ..... H01H 1/226 218/20
5,296,664 A * 3/1994 Crookston ..... H01H 71/501 200/401
5,300,907 A * 4/1994 Nereau ..... H01H 1/2058 335/172
5,310,971 A * 5/1994 Vial ..... H01H 1/205 200/244
5,313,180 A * 5/1994 Vial ..... H01H 1/205 218/31
5,357,066 A * 10/1994 Morel ..... H01H 1/205 200/17 R
5,379,013 A * 1/1995 Coudert ..... H01H 71/06 335/17
5,440,088 A * 8/1995 Coudert ..... H01H 71/465 200/303
5,449,871 A * 9/1995 Batteux ..... H01H 71/501 200/401
5,457,295 A * 10/1995 Tanibe ..... H01H 71/0228 200/293
5,467,069 A * 11/1995 Payet-Burin ..... H01H 71/7463 335/10
5,469,121 A * 11/1995 Payet-Burin ..... H01H 1/2066 218/22
5,477,016 A * 12/1995 Baginski ..... H01H 9/282 200/308
5,504,290 A * 4/1996 Baginski ..... H01H 3/3031 200/330
5,534,832 A * 7/1996 Duchemin ..... H01H 89/08 218/22
5,608,367 A * 3/1997 Zoller ..... H01H 71/7409 335/132
6,166,344 A * 12/2000 Castonguay ..... H01H 71/501 200/325
6,222,433 B1 * 4/2001 Ramakrishnan ..... H01H 1/2058 200/308
6,340,925 B1 * 1/2002 Castonguay ..... H01H 1/2058 335/167
6,346,868 B1 * 2/2002 Castonguay ..... H01H 1/2058 335/167
6,400,245 B1 * 6/2002 Castonguay ..... H01H 1/2058 200/50.05
6,448,521 B1 * 9/2002 Castonguay ..... H01H 71/525 200/318
6,448,522 B1 * 9/2002 Rosen ..... H01H 1/2058 200/322
6,476,337 B2 * 11/2002 Castonguay ..... H01H 1/2058 200/330
6,479,774 B1 * 11/2002 Castonguay ..... H01H 1/2058 200/244
6,531,941 B1 * 3/2003 Greenberg ..... H01H 71/08 200/293
6,586,693 B2 * 7/2003 Castonguay ..... H01H 1/2058 200/318
6,639,168 B1 * 10/2003 Castonguay ..... H01H 1/205 218/22
6,803,536 B1 * 10/2004 Slepian ..... H01H 71/528 200/244
6,943,652 B2 * 9/2005 Rodriguez ..... H01H 71/0228 335/13
7,504,914 B2 * 3/2009 Christmann ..... H01H 71/40 335/2
8,350,168 B2 * 1/2013 Faik ..... H01H 1/2041 200/244
2007/0215577 A1 9/2007 Park

OTHER PUBLICATIONS

Chinese Patent Office, Chinese Search Report & Written Opinion, May 28, 2019, 1-8 pp. China.

* cited by examiner

SWITCHING DEVICE FOR LV ELECTRIC INSTALLATIONS

The present invention relates to the field of switching devices (such as circuit breakers, contactors, disconnectors and the like) for low voltage electric installations.

For the purposes of the present application, the term "low voltage" (LV) relates to operating voltages lower than 1 kV AC and 1.5 kV DC.

As is known, switching devices for LV electric installations comprise one or more electric poles intended to be electrically connected to the conductors of a LV electric line.

Each electric pole comprises one or more mobile contacts and fixed contacts that can be mutually coupled/uncoupled.

Typically, a LV switching device comprises mechanical control means adapted to provide an actuation force to move the mobile contacts from a coupling position to an uncoupling position with the corresponding fixed contacts, or vice-versa.

In many LV switching devices (as in the one described in the patent application nr. PCT/EP2009/067995) the mentioned mechanical control means comprise an outer handle, which is intended to be operated by a user or an actuator (e.g. a MOE—Motor Operated Actuator) to perform an opening or a closing manoeuvre of the switching device.

In traditional switching devices, an opening manoeuvre generally requires a relatively long time (even up to some seconds) to be completed.

This is a critical aspect for the operating life of the switching device as such a long time to separate the electric contacts favours the occurrence of huge and prolonged electric arc phenomena with consequent wear and shortening of the useful operating life of the electric contacts themselves.

As it is easy to understand, all these drawbacks entail relatively high operative costs for the switching device, as maintenance interventions on the electric contacts are frequently required.

In the field of LV switching devices for LV installations, it is thus quite felt the need for new solutions to reduce the time required to separate the electric contacts during an opening manoeuvre.

On the other hand, the experience has shown how this task is quite problematic to carry out as the mentioned mechanical control means have generally a quite complex structure difficult to put together to ensure all the functionalities requested for the operating life of the switching device It is an object of the present invention to provide a switching device for LV electric installations, which allows overcoming the above-mentioned problems.

More in particular, it is an object of the present invention to provide a switching device, in which a short time is required to separate the electric contacts during an opening manoeuvre. Another object of the present invention is to provide a switching device having a simple and compact structure that is easy to manufacture and assembly at industrial level.

Another object of the present invention is to provide a switching device that can be realized, at industrial level, at competitive costs in comparison to currently available switching devices of the same type.

In order to achieve these aim and objects, the present invention provides a switching device, according to the following claim 1 and related dependent claims.

In a general definition, the switching device, according to the invention, comprises:

- one or more electric poles, each of which comprises one or more mobile contacts and one or more fixed contacts adapted to be coupled or uncoupled;
- a mobile contact assembly comprising said mobile contacts and reversibly movable between a first contact position, at which said movable contacts and said fixed contacts are coupled, and second contact position, at which said movable contacts and said fixed contacts are uncoupled;
- a mechanical control assembly for operating said mobile contact assembly.

Such a mechanical control assembly comprises a control mechanism for reversibly moving said mobile contact assembly between said first and second contact positions and a trip mechanism operatively coupled with said control mechanism, which comprises a trip shaft reversibly movable between a first trip position and a second trip position.

Said control mechanism is adapted to move said mobile contact assembly from said first contact position to said second contact position in response to a movement of said trip shaft from said first trip position to said second trip position.

Said mechanical control assembly comprises a handle mechanism operatively coupled with said control mechanism, which comprises a handle adapted to be reversibly moved by a user or an outer actuator between a first handle position and a second handle position in order to carry out a closing or an opening manoeuvre of the switching device.

Said control mechanism is adapted to move said mobile contact assembly from said first contact position to said second contact position in response to a movement of said handle from said first handle position to said second handle position (opening manoeuvre) and to move said mobile contact assembly from said second contact position to said first contact position in response to a movement of said handle from said second handle position to said first handle position (closing manoeuvre).

According to the invention, said mechanical control assembly comprises an activation mechanism adapted to operatively couple said handle mechanism with said trip shaft in order to actuate said trip shaft during an opening manoeuvre of the switching device, when said handle is operated by a user or an outer actuator.

In particular, said activation mechanism is adapted to operatively couple said handle mechanism with said trip shaft in order to move said trip shaft from said first trip position to said second trip position during an opening manoeuvre of the switching device, namely during a movement of said handle from said first handle position towards said second handle position upon an actuation by a user or an outer actuator.

Preferably, said activation mechanism is adapted to be actuated by said handle mechanism and to transmit a force to said trip shaft to move said trip shaft from said first trip position to said second trip position during an opening manoeuvre of the switching device, in particular during a movement of said handle from said first handle position towards said second handle position upon the actuation by a user or an outer actuator.

Preferably, said activation mechanism comprises an activation lever hinged to a support element and movable with respect to said support element.

Preferably, said activation lever is translationally and rotationally movable with respect to said support element.

Preferably, the activation lever is adapted to be actuated by said handle mechanism when said handle moves from said first handle position towards said second handle position.

Preferably, the activation lever is adapted to move translationally with respect to said support element from a first lever position to a second lever position and transmit a force to said trip shaft to move said trip shaft from said first trip position to said second trip position in response to an actuation by said handle mechanism during an opening manoeuvre of the switching device, in particular during a movement of said handle from said first handle position towards said second handle position upon the actuation by a user or an outer actuator. According to some embodiments of the invention, said support element is fixed with respect to an outer casing of said switching device.

In this cases, said activation lever is adapted to be actuated by the trip shaft to return in the first lever position during a movement of said trip shaft from said second trip position to said first trip position.

Furthermore, said activation lever is adapted to be actuated by the handle mechanism and rotationally move with respect to said support element during a closing manoeuvre of the switching device, in particular during a movement of said handle from said second handle position to said first handle position upon the actuation by a user or an outer actuator.

According to other embodiments of the invention, said support element is movable with respect to an outer casing of said switching device.

In these cases, said activation lever is adapted to be actuated by said support element to return in said first lever position during a closing manoeuvre of the switching device, in particular during a movement of said handle from said second handle position to said first handle position upon the actuation by a user or an outer actuator.

Furthermore, said activation lever is adapted to remain uncoupled from said handle mechanism during a closing manoeuvre of the switching device, in particular during a movement of said handle from said second handle position to said first handle position upon the actuation by a user or an outer actuator.

Further characteristics and advantages of the present invention will emerge from the description of preferred, but not exclusive, embodiments, non-limiting examples of which are provided in the attached drawings, in which.

Figure 1:
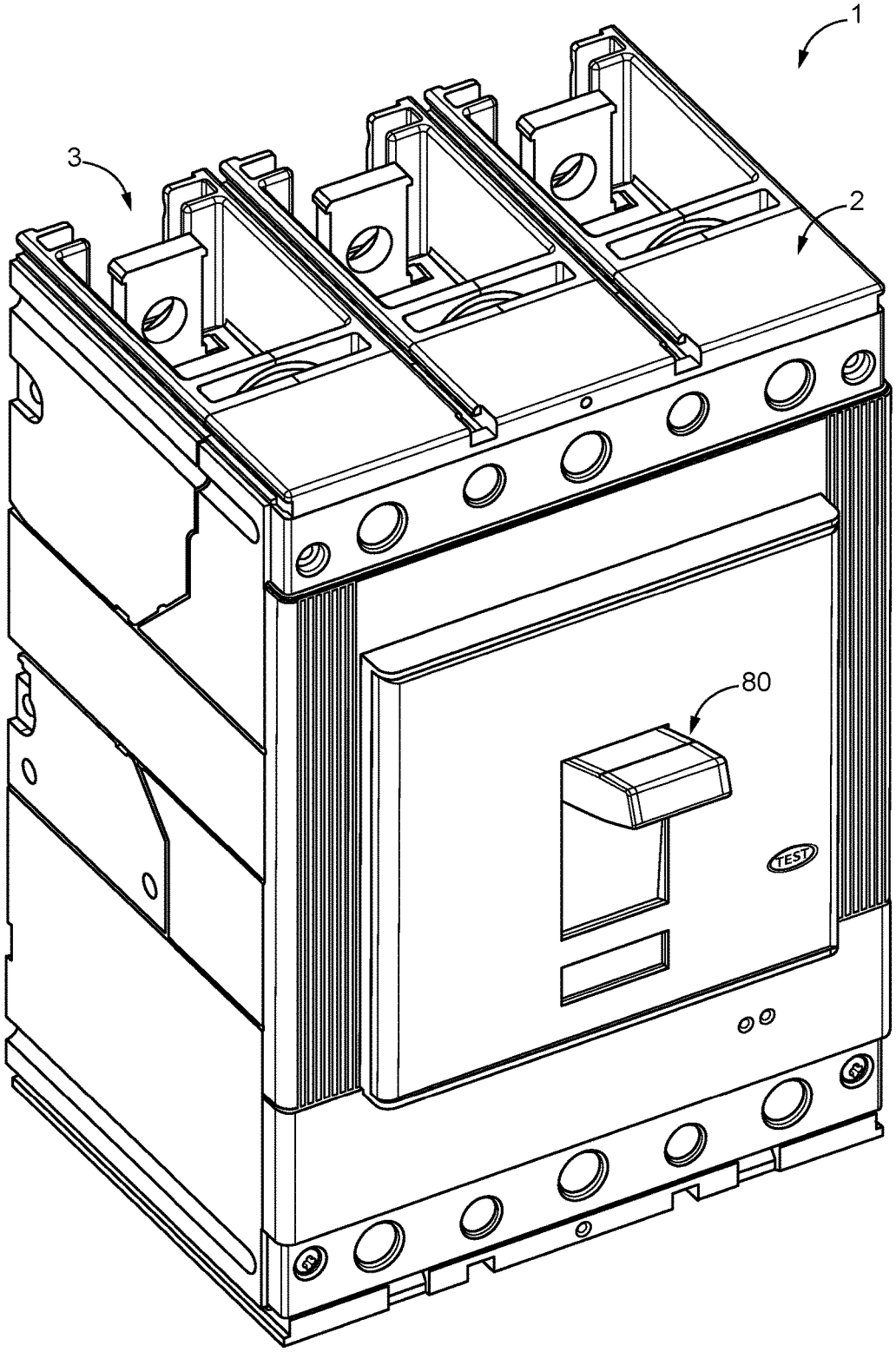
FIGS. 1-7 show a schematic view of an embodiment of the switching device, according to the invention.

Referring to the cited figures, the present invention relates to a switching device 1 suitable to be installed in a LV electric switchgear panel or, more generally, in a LV electric power distribution grid.

As an example, the switching device 1 may be an automatic MCCB (Molded Case Circuit Breaker) for LV applications.

Preferably, the switching device 1 comprises an outer casing 2 defining an internal volume 10 of the switching device (FIGS. 1-2, 8-9).

The outer casing 2 may be arranged, in many respects, according to solutions known to the skilled person and it is not described with a high degree of detail for the sake of brevity.

In general, the outer casing 2 comprises a plurality of shaped portions having protrusions and cavities at least partially geometrically conjugated or complementary to define the internal volume 10 of the switching device and ensure a suitable mutual mechanical coupling.

The outer casing 2 may be made of an electrically insulating material (e.g. thermosetting resins).

However, in some applications (e.g. when the switching device 1 is an air circuit breaker), the outer casing 2, or some portions thereof, can be made of an electrically conductive material. Of course, in these cases, suitable insulating elements need to be arranged between the electrically powered members of the switching device and the outer casing 2.

The switching device 1 comprises one or more electric poles 3.

Each electric pole 3 comprises one or more mobile contacts 31 and one or more fixed contacts 32 adapted to be coupled or uncoupled.

When the electric contacts 31, 32 are coupled, the switching device 1 is in a closing state whereas, when the electric contacts 31, 32 are uncoupled, the switching device 1 is in an opening state or a tripping state.

In the embodiments shown in the cited figures, the switching device 1 is of the three-pole type and comprises three electric poles 3, each comprising a plurality of fixed contacts 32 and a plurality of mobile contacts 31 that can be coupled or uncoupled.

Other solutions are however possible depending on the specific application of the switching device 1.

The electric poles 3 and the electric contacts 31, 32 may be arranged, in many respects, according to solutions known to the skilled person and it is not described in a high degree of detail for the sake of brevity.

Figure 3:
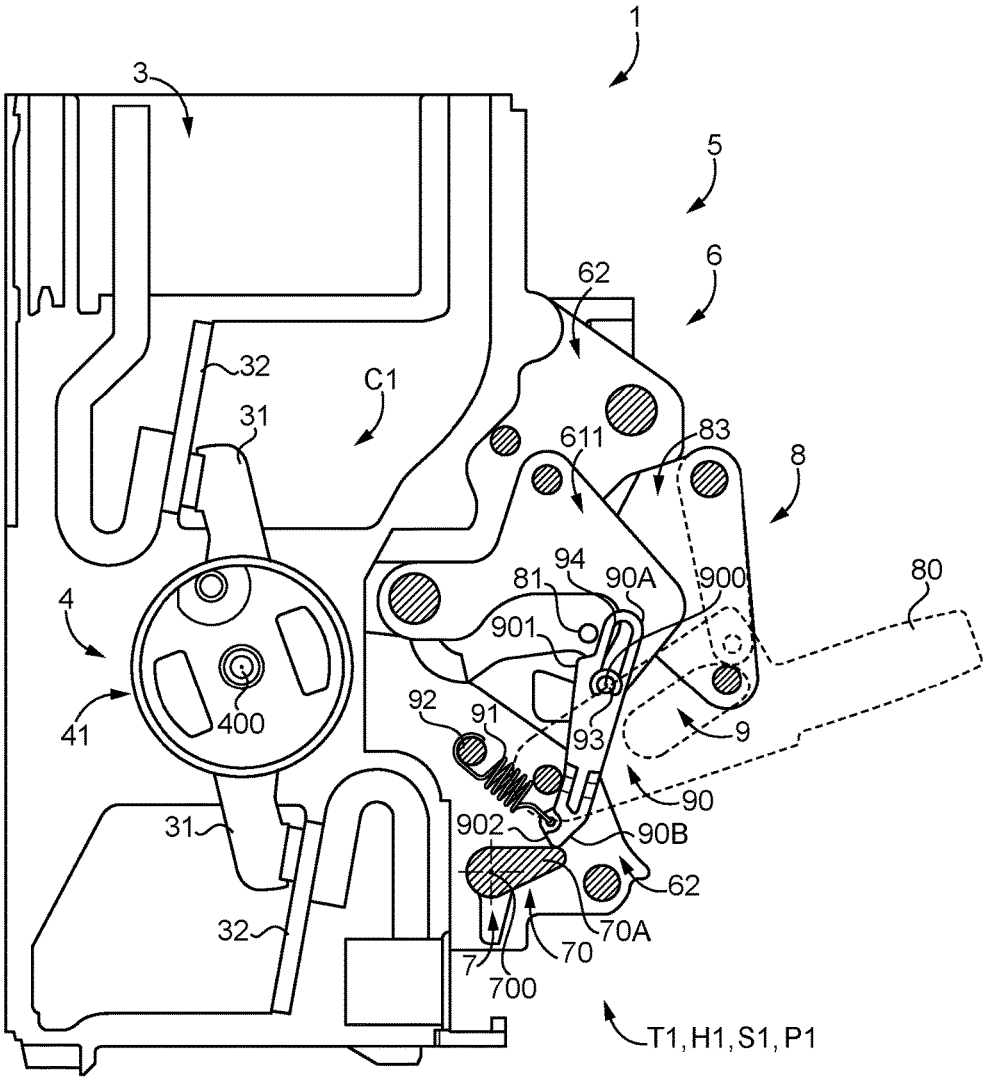

In some embodiments of the switching device (as shown in the FIG. 3), each mobile contact 31 may be adapted to be coupled/uncoupled at its opposite ends with/from a corresponding pair of fixed contacts 32 (double breaking configuration) in turn electrically connected to an electric power distribution line.

According to other embodiments (not shown), each mobile contact may 31 may have an end intended to be coupled/uncoupled with/from a corresponding fixed contact and an opposite end electrically connected to an electric power distribution line.

Further solutions are possible depending on the specific application of the switching device 1. The switching device 1 comprises a mobile contact assembly 4 including the mobile contacts 31 and at least partially accommodated in the internal volume 10 of the switching device. Also the mobile contact assembly 4 may be arranged, in many respects, according to solutions known to the skilled person and it is not described with a high degree of detail for the sake of brevity.

In general, the mobile contact assembly 4 comprises a contact shaft 41 adapted to rotate about a first rotation axis 400 during a switching operation of the switching device.

Preferably, the contact shaft 41 has an elongated shaped body (e.g. of cylindrical type) extending longitudinally along its rotation axis 400 and at least partially made of an insulating material (e.g. a thermosetting resin).

Preferably, the contact shaft 41 comprises one or more contact seats (not shown) adapted to accommodate, at least partially, one or more mobile contacts 31 in such a way these latter protrude from the main body thereof, perpendicularly with respect to the longitudinal axis 400. In this way, the mobile contacts 31 and the contact shaft 4 can solidly rotate about the rotation axis 400 during a switching operation of the switching device.

Other solutions are however possible depending on the specific application of the switching device 1.

The mobile contact assembly 4 is reversibly movable between a first contact position C1, at which the movable contacts 31 and the fixed contacts 32 are coupled, and a second contact position C2, at which the movable contacts 31 and the fixed contacts 32 are uncoupled.

In the cited figures, the mobile contact assembly 4 is shown only in the embodiment of FIGS. 1-7 for the sake of brevity. However, the mentioned mobile contact assembly is an essential part also of the embodiment of FIGS. 8-16.

The switching device 1 comprises a mechanical control assembly 5 for operating the mobile contact assembly 4.

The mechanically control assembly 5 is at least partially accommodated in the internal volume 10 of the switching device 1.

The mechanical control assembly 5 comprises a control mechanism 6 for reversibly moving the mobile contact assembly 4 between the first and second contact positions C1, C2.

Also the control mechanism 6 may be arranged, in many respects, according to solutions known to the skilled person and it is not described with a high degree of detail for the sake of brevity.

In general, the control mechanism 6 is adapted to take different operative configurations, namely a closing, a tripping or an opening configuration, which relate to corresponding manoeuvres of the switching device, namely a closing, a tripping or an opening manoeuvre, respectively.

When the control mechanism 6 takes a closing configuration, the mobile contact assembly 4 moves in the first contact position C1 and the switching device takes a closing state (closing manoeuvre of the switching device).

When the control mechanism takes a tripping configuration or an opening configuration, the mobile contact assembly 4 moves in the second contact position C2 and the switching device takes a tripping state or an opening state, respectively (tripping or opening manoeuvre of the switching device).

Preferably, the control mechanism 6 comprises movable control members 61, 611 (e.g. shafts, rods, springs, levers or the like), which are operatively arranged in such a way to be capable to provide a force to move the contact assembly 4.

Preferably, the control mechanism 6 comprises supporting frame members 62, 621 (e.g. shaped frame plates or the like), which are fixed to the outer casing 2 (e.g. by means of screws, bolts or tie-rods or the like) to provide support to the movable members 61, 611.

The mechanical control assembly 5 comprises a trip mechanism 7 operatively coupled with the control mechanism 6.

Also the trip mechanism 7 may be arranged, in many respects, according to solutions known to the skilled person and it is not described with a high degree of detail for the sake of brevity. In general, the trip mechanism 7 is adapted to trip the control mechanism 6 to automatically move the contact assembly 4 from the first contact position C1 to the second contact position C2 in response to a trip event (tripping manoeuvre of the switching device).

In this way, a rapid separation of the electric contacts may be obtained in response to a trip event.

The trip mechanism 7 comprises a trip shaft 70 adapted to reversibly rotate about a second rotation axis 700 between the first and second trip positions T1, T2.

Preferably, the second rotation axis 700 is parallel to the first rotation axis 400.

The trip shaft 70 and the control mechanism 6 are operatively coupled in such a way that the control mechanism 6 moves the mobile contact assembly 4 from the first contact position C1 to the second contact position C2 in response to a movement of the trip shaft 70 from the first trip position T1 to the second trip position T2.

The control mechanism 6 is advantageously adapted to pass from a closing configuration (corresponding to a closing state of the switching device), at which the mobile contact assembly 4 is in the first contact position C1, to a tripping configuration (corresponding to a tripping state of the switching device), at which the mobile contact assembly 4 is in the second contact position C2, in response to a movement of the trip shaft 70 from the first trip position T1 to the second trip position T2 (tripping manoeuvre of the switching device). Similarly to known solutions of the state of the art, the trip shaft 70 may be advantageously operated (trip event) by a protection device (not shown), which is operatively associated with the switching device 1 and intervenes in case of anomaly (e.g. a short circuit event, an over-current event, a fault event, or the like) occurring in the electric grid in which the switching device is installed.

Such a protection device may be, for example, of the thermal, thermomagnetic or electronic type and it may be designed according to known solutions of the state of the art.

The mechanical control assembly 5 comprises a handle mechanism 8 operatively coupled with the control mechanism 6.

Also the handle mechanism 8 may be arranged, in many respects, according to solutions known to the skilled person and it is not described with a high degree of detail for the sake of brevity.

In general, the handle mechanism 8 is adapted to be operated by a user or an outer actuator (e.g. a motor operated equipment) to force the control mechanism 6 to move the contact assembly 4 from the first contact position C1 to the second contact position C2 (opening manoeuvre of the switching device) or from the second contact position C2 to the second first contact position C1 (closing manoeuvre of the switching device).

In some circumstances, i.e. when the control mechanism 6 is activated by the trip shaft 70, the handle mechanism 8 is actuated by the control mechanism 6 as the consequence of the passage of this latter from a closing configuration to a tripping configuration (tripping manoeuvre of the switching device).

The handle mechanism 8 comprises an outer handle 80, which is the mechanical member adapted to be directly operated by a user or an outer actuator.

Figure 2:
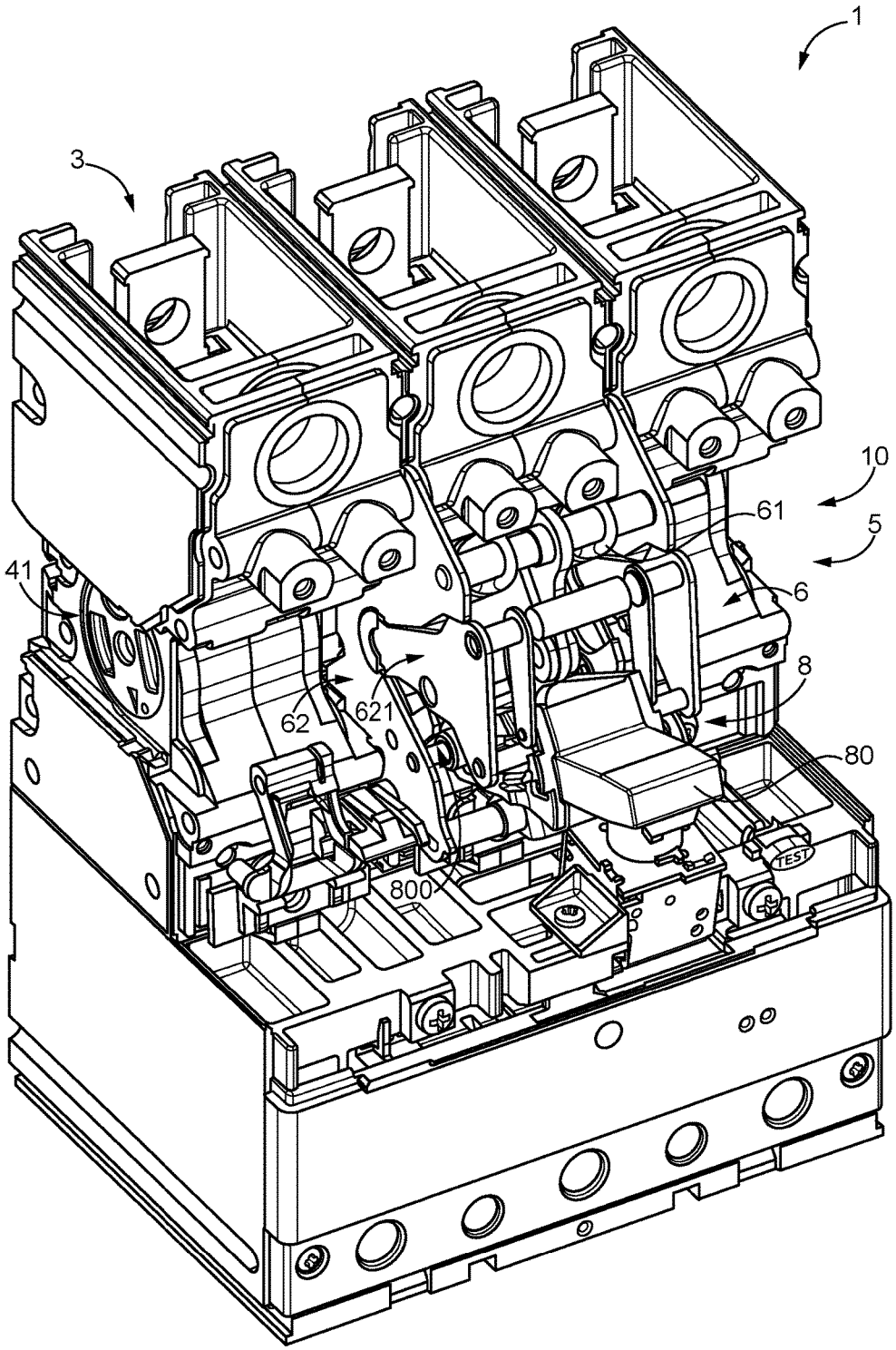

Preferably, the handle 8 is rotatable about a third rotation axis 800 (shown only in FIG. 2). Preferably, the third rotation axis 800 is parallel to the first and second rotation axes 400, 700. The handle mechanism 8 comprises suitable coupling members 83 for coupling the handle 80 with the control mechanism 6.

The handle mechanism 8 is arranged in such a way that the handle 80 can take a first handle position H1, a second handle position H2 and a third handle position H3, which is intermediate between the first and second handle positions H1, H2.

The handle mechanism 8, in particular the handle 80, and the control mechanism 6 are operatively coupled in such a way that the handle 80 is reversibly movable between the first handle position H1 and the second handle position H2 upon an actuation by a user or an outer actuator in order to perform an opening or a closing manoeuvre of the switching device.

The control mechanism 6 passes from a closing configuration to an opening configuration in response to a movement of the handle 80 from the first handle position H1 to the second handle position H2 (opening manoeuvre of the switching device).

The control mechanism 6 passes from an opening configuration to a closing opening configuration in response to a movement of the handle 80 from the second handle position H2 to first handle position H1 (closing manoeuvre of the switching device).

The handle mechanism 8, in particular the handle 80, and the control mechanism 6 are operatively coupled in such a way that the handle 80 moves from the first handle position H1 to the third handle position H3 upon the actuation by the control mechanism 6, when this latter passes from a closing configuration to a tripping configuration (tripping manoeuvre of the switching device).

The handle 80 can thus automatically pass from the first handle position H1 to the third handle position H3 in response to a movement of the trip shaft 70 from the first trip position T1 to the second trip position T2.

The handle mechanism 8, in particular the handle 80, and the control mechanism 6 are operatively coupled in such a way that the handle 80 is movable from the third handle position H3 to the second handle position H2 upon the actuation by a user or an outer actuator.

The control mechanism 6 passes from a tripping configuration to an opening configuration in response to a movement of the handle 80 from the third handle position H3 to the second handle position H2.

The contact assembly 4 is stably maintained in the second contact position C2 when the control mechanism 6 passes from a tripping configuration to an opening configuration in response to a movement of the handle 80 from the third handle position H3 to the second handle position H2.

The handle mechanism 8, in particular the handle 80, and the control mechanism 6 are operatively coupled in such a way that the handle 80 cannot be directly moved from the third handle position H3 to the first handle position H1 but it must necessarily be moved from the third handle position H3 to the second handle position H2 and then from the second handle position H2 to the first handle position H1 upon the actuation by a user or an outer actuator. The control mechanism 6 must thus pass through an opening configuration in order to pass from a tripping configuration to a closing configuration.

An essential differentiating feature of the present invention with respect to traditional switching devices of the state of the art consists in that the mechanical control assembly 5 comprises an activation mechanism 9 for coupling the handle mechanism 8 with the trip shaft 70 in order to actuate this latter during an opening manoeuvre of the switching device operated by a user or an outer actuator.

In particular, the activation mechanism 9 is adapted to couple the handle mechanism 8 with the trip shaft 70 in order to move this latter from the first trip position T1 to the second trip position T2, when the handle 80 is moved from the first handle position H1 towards the second handle position H2 upon the actuation by a user or an outer actuator.

The activation mechanism 9 is thus adapted to actuate the trip shaft 70 during an opening manoeuvre (performed by a user or an outer actuator) in such a way that the separation of the electric contacts 31, 32 is obtained by means of the passage of the control mechanism from a closing configuration to a tripping configuration.

In practice, the activation mechanism 9 is capable to force the control mechanism 6 to pass through a tripping configuration before taking an opening configuration during an opening manoeuvre of the switching device.

Thanks to the activation mechanism 9, the movement of the handle 80 from the first handle position H1 towards the second handle position H2 upon the actuation by a user or an outer actuator (opening manoeuvre of the switching device) becomes equivalent to a trip event, which causes the intervention of the trip shaft 70 that, in turn, trips the control mechanism 6 to pass from a closing configuration to a tripping configuration before the opening manoeuvre is completed.

In other words, the activation mechanism 9 is capable to force the control mechanism 6 to perform a tripping manoeuvre to obtain the separation of the electric contact 31, 32 before an opening manoeuvre in progress is completed.

This fact allows obtaining a rapid separation of the electric contacts 31, 32 even if the handle 80 is actuated by a user or an outer actuator. Shorter separation times of the electric contacts 31, 32 during an opening manoeuvre of the switching device are therefore obtained.

Preferably, the activation mechanism 9 is arranged in such a way to be actuated by the handle mechanism 8 to transmit a force to the trip shaft 70 to move this latter from the first trip position T1 to the second trip position T2 during an opening manoeuvre of the switching device, when the handle 80 moves from the first handle position H1 towards the second handle position H2 upon the actuation by a user or an outer actuator.

Preferably, the activation mechanism 9 is arranged in such a way to not transmit forces to the trip shaft 70 during a closing manoeuvre of the switching device, when the handle 80 moves from the second handle position H2 to the first handle position H1 upon the actuation by a user or an outer actuator.

Preferably, the activation mechanism 9 is arranged in such a way to not transmit forces to the trip shaft 70 during a normal tripping manoeuvre of the switching device, which is caused by a protection device operatively associated with the switching device.

In this case, in fact, the trip shaft 70 is actuated by the protection device and the activation mechanism 9 does not transmit forces to the trip shaft even if it is actuated by the handle mechanism 8 in response to the automatic movement of the handle 80 from the first handle position H1 to the third handle position H3.

According to preferred embodiments of the invention, the activation mechanism 9 comprises an activation lever 90 hinged to a support element 611, 621.

Preferably, the activation lever 90 is movable in a reversible way with respect to the support element 611, 621.

Preferably, the activation lever 90 is translationally movable with respect to the support element 611, 621.

Preferably, the activation lever 90 is also rotationally movable with respect to the support element 611, 621 about a fourth rotation axis 900.

Preferably, the rotation axis 900 is parallel to the rotation axes 400, 700, 800.

Preferably, the activation lever 90 comprises a first coupling portion 901, at which it is coupleable with an actuation element 81 of the handle mechanism 8.

Advantageously, such an actuation element 81 is arranged to relatively move with respect to the activation lever 90 to actuate this latter when the handle 80 moves.

Preferably, the activation lever 90 comprises a second coupling portion 902, at which it is coupleable with the trip shaft 70.

Preferably, the activation lever 90 is coupleable with a protruding finger 70A of the trip shaft 70 at the second coupling portion 902.

Preferably, the activation mechanism 9 is arranged in such a way that:

- the activation lever 90 is actuated by the actuation element 81 of the handle mechanism 8 during an opening manoeuvre of the switching device, i.e. during a movement of the handle 80 from said first handle position H1 towards said second handle position H2 upon the actuation by a user or an outer actuator;
- the activation lever 90 moves translationally from a first lever position P1 to a second lever position P2 with respect to the support element 611, 621 and transmits a force to the trip shaft 70 to move this latter from the first trip position T1 to the second trip position T2 in response to the actuation by the handle mechanism 8.

Preferably, from a kinematic point of view, the activation lever 90 substantially behaves in a same way during a normal tripping manoeuvre caused by a protection device operatively associated with the switching device.

In this case, however, the actuation lever 90 does not transmit forces to the trip shaft 70 even if it is actuated by the handle mechanism 8 in response to the automatic movement of the handle 80 from the first handle position H1 to the third handle position H3.

The trip shaft 70 is in fact actuated by the protection device.

According to some embodiments, the support element 621 may be fixed with respect to the outer casing 2.

In this case, the activation mechanism 9 is arranged in such a way that the activation lever 90 is actuated by the trip shaft 70 to return in the first lever position P1 during a return movement of the trip shaft 70.

Furthermore, the activation mechanism 9 is arranged in such a way that the activation lever 90 is actuated by the handle mechanism 8 and rotationally moves with respect to the support element 621 during a closing manoeuvre of the switching device, i.e. during a movement of the handle 80 from the second handle position H2 to the first handle position H1 upon the actuation by a user or an outer actuator.

According to some embodiments, the support element 611 may be movable with respect to the outer casing 2.

In this case, the activation mechanism 9 is arranged in such a way that the activation lever 90 is actuated by the support element 611 to return in the first lever position P1 during a closing manoeuvre of the switching device, i.e. during a movement of the handle 80 from the second handle position H2 to the first handle position H1 upon the actuation by a user or an outer actuator.

Furthermore, the activation mechanism 9 is arranged in such a way that the activation lever 90 remains uncoupled from the handle mechanism 8 during a closing manoeuvre of the switching device, i.e. during a movement of the handle 80 from the second handle position H2 to the first handle position H1 upon the actuation by a user or an outer actuator.

Preferably, the activation mechanism 9 comprises an elastic element 91 (e.g. a spring) operatively connected with the activation lever 90 and a connection point 92 that is fixed with respect to the outer casing 2.

As it will emerge more clearly from the following description, the elastic element 91 is arranged in such a way to exert a biasing force to favour or contrast a rotation of the activation lever 90 with respect to the support element 611, 621.

Referring now to FIGS. 1-7, a possible embodiment of the switching device 1, according to the invention, is now described in more details.

According the embodiment of FIGS. 1-7, the activation mechanism 9 comprises an activation lever 90, which has an elongated body having opposite first and second ends 90A, 90B.

The activation lever 90 is hinged (e.g. by means of a suitable connection pin) to the support element 611 at the hinging point 93.

According the embodiment of FIGS. 1-7, the support element 611 is movable with respect to the outer casing 2.

Preferably, the support element 611 is a control lever of the control mechanism 6, which moves from a first control position S1 to a second control position S2, when the control mechanism 6 passes from the above mentioned closing configuration to the above mentioned tripping configuration (tripping manoeuvre of the switching device), and moves from the second control position S2 to a first control position S1, when the control mechanism 6 passes from the above mentioned opening configuration to the above mentioned closing configuration (closing manoeuvre of the switching device).

As an example, the support element 611 may be the so-called "welded contacts lever" of the control mechanism 6.

The activation lever 90 is movable with respect to the support element 611 at the hinging point 93.

The activation lever 90 is configured to be reversibly movable in a translational way with respect to the support element 611.

To this aim, the activation lever 90 comprises the slot 94 along which the hinging point 93 slides when the activation lever 90 translationally moves with respect to the support element 611.

As shown in FIGS. 1-7, the slot 94 is advantageously at the first end 90A of the activation lever 90.

The activation lever 90 is configured to be rotationally movable with respect to the support element 611 at the hinging point 93 about the third rotation axis 900.

The activation lever 90 comprises a first coupling portion 901, at which it is coupleable with the actuation element 81 of the handle mechanism 8.

As shown in FIGS. 1-7, the first coupling portion 901 is advantageously positioned at the first end 90A of the activation lever 90.

Advantageously, the activation lever 90 is coupleable with an actuation element 81 of the handle mechanism 8 at the first coupling portion 901, which can relatively move with respect to the activation lever 90 when the handle 80 moves.

As shown in FIGS. 1-7, the actuation element 81 may be an actuation pin arranged substantially parallel to the rotation axis 900 and protruding from one of the coupling members 83 of the handle mechanism 8.

The activation lever 90 comprises a second coupling portion 902, at which it is coupleable with the trip shaft 70, when this latter is in the first trip position T1.

Preferably, at the second coupling portion 902, the activation lever 90 is coupleable with a protruding finger 70A of the trip shaft 70.

As shown in FIGS. 1-7, the second coupling portion 902 is advantageously positioned at the second end 90B of the activation lever 90.

According to the embodiment of FIGS. 1-7, the actuation mechanism 9 comprises a spring 91 operatively connected with the activation lever 90 and a connection point 92 that is fixed with respect to the outer casing 2.

Advantageously, the spring 91 is coupled with the activation lever 90 in a distal position with respect to the first end 90A thereof, namely at the second end 90B.

In this way, the spring 91 may exert a biasing force to favour or contrast a rotation of the activation lever 90 with respect to the support element 611 about the rotation axis 900.

The operation of the switching device 1 in the embodiment of FIGS. 1-7 is now disclosed in more details.

The switching device 1 is initially supposed to be in a closing state.

In this situation (FIG. 3):

- the electric contacts 31, 32 are coupled, the mobile contact assembly 4 is in the first contact position C1, the trip shaft 70 is in the first trip position T1, the activation lever is in the first lever position P1, the support element 611 is in the first control position S1 and the handle 80 is in the first handle position H1;
- the actuation element 81 is not coupled with the activation lever 90 and the activation lever 90 is coupled with the trip shaft 70 without exerting any force on this latter;
- the spring 91 advantageously biases the end 90B of the activation lever 90 to maintain this latter properly positioned with respect to the trip shaft 70, thereby preventing undue rotations of the activation lever 90.

Figure 4:
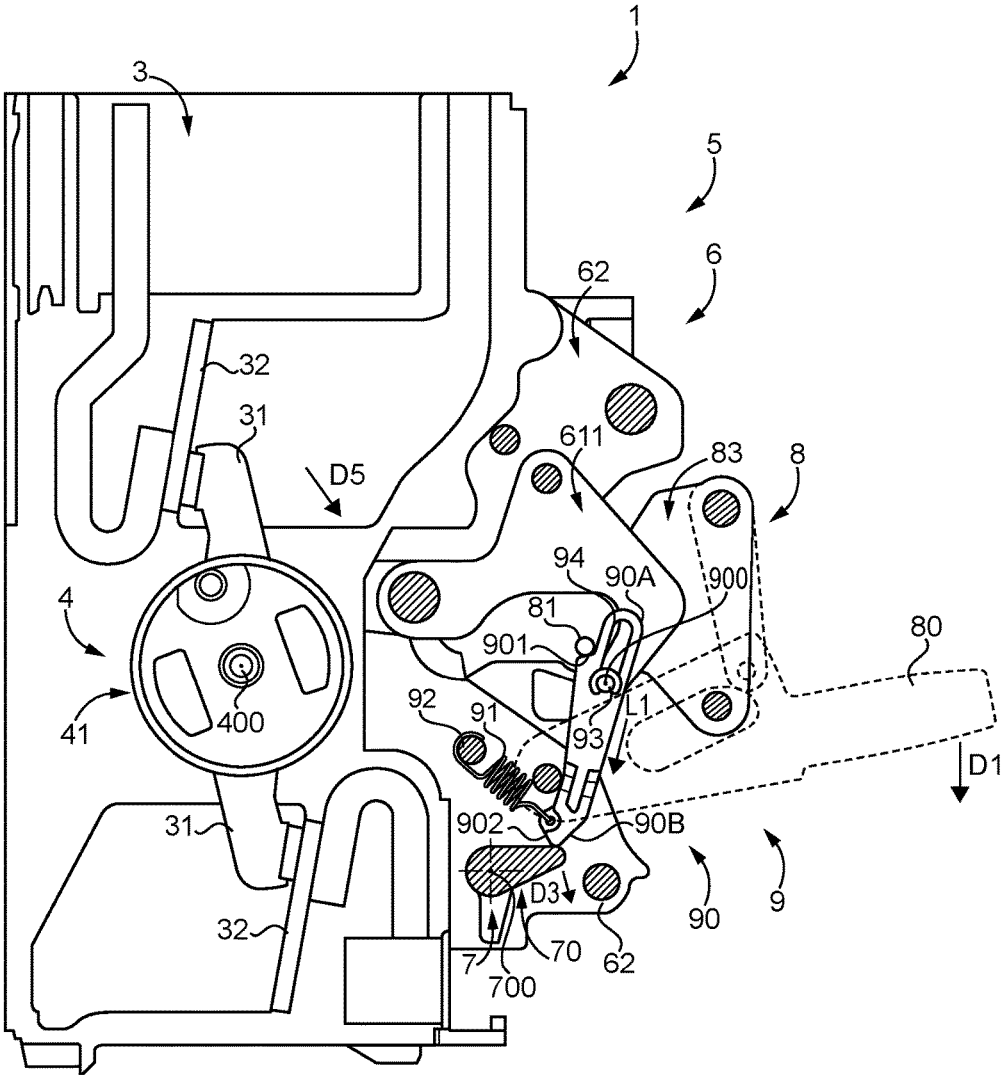
Figure 5:
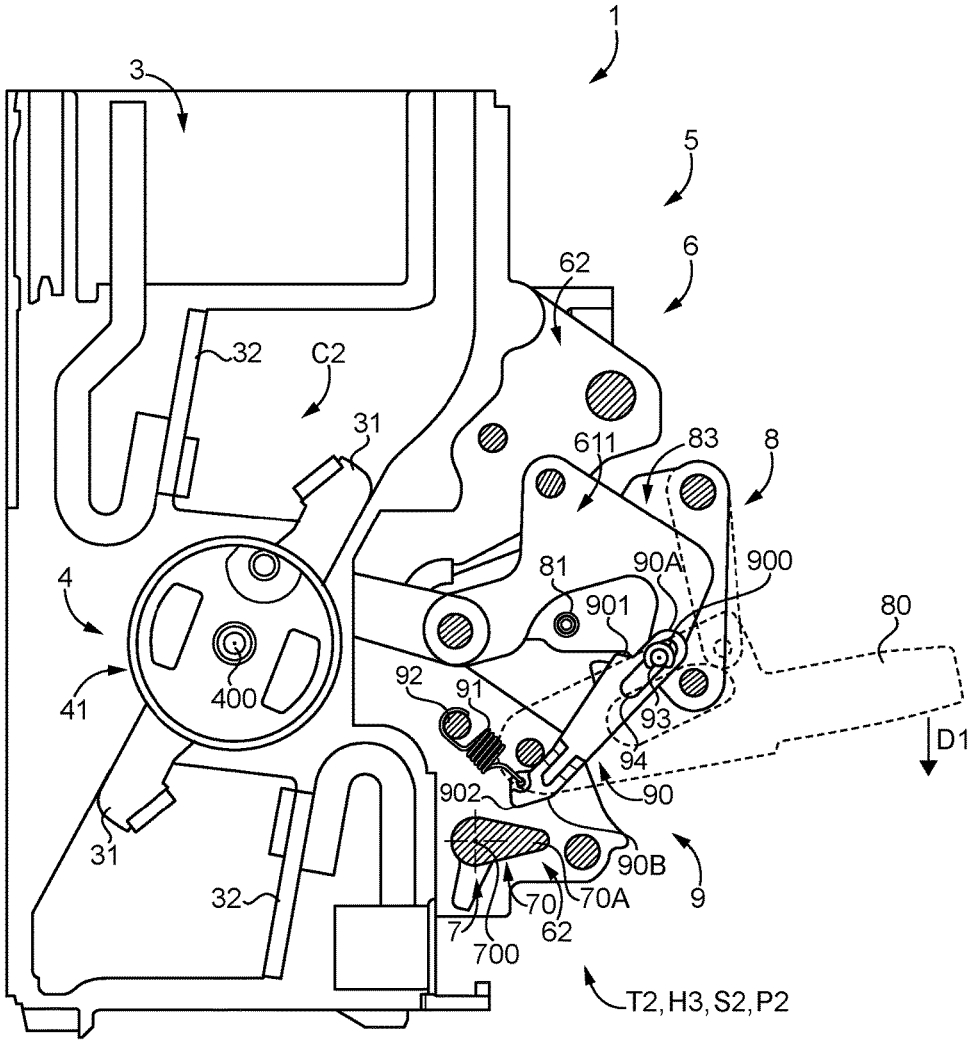
Figure 6:
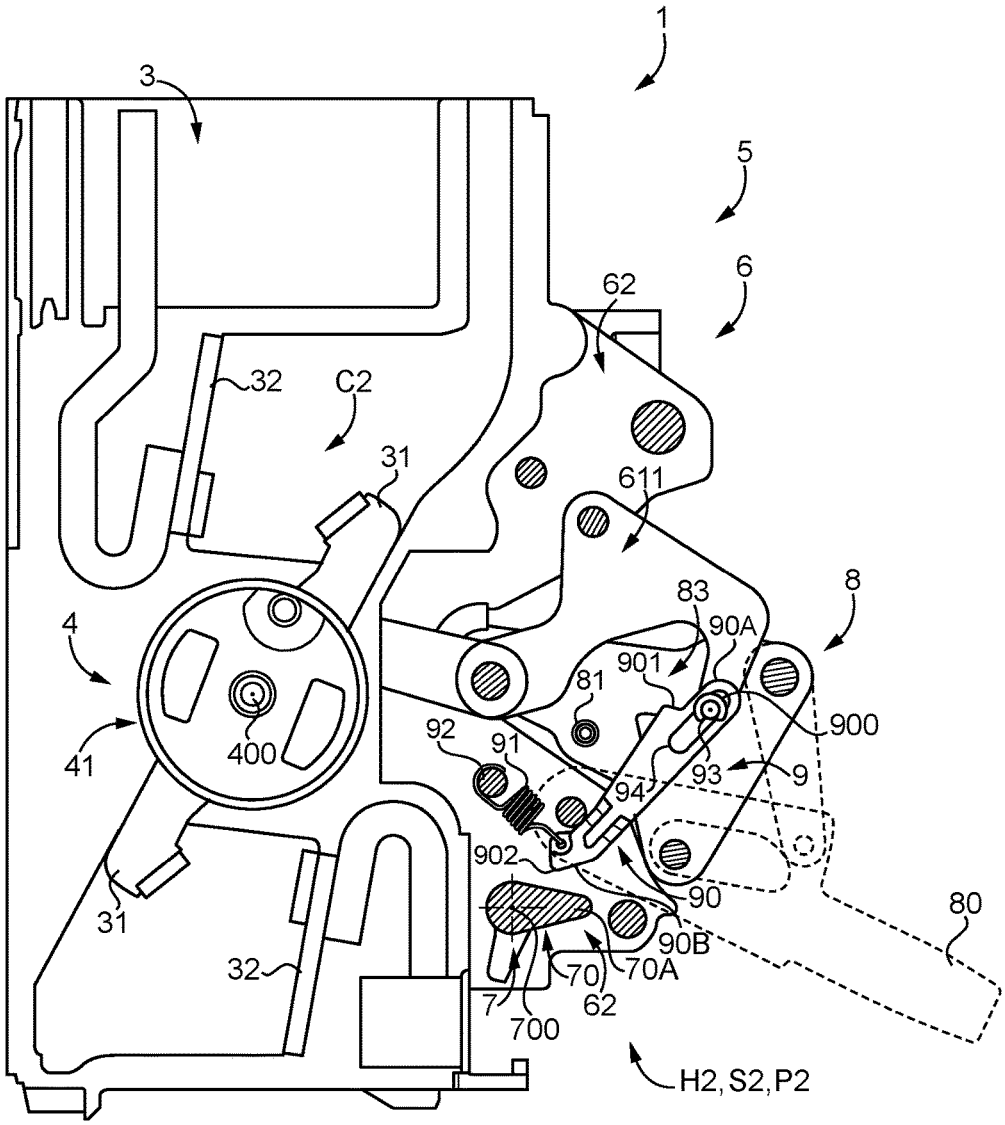

In order to perform an opening manoeuvre of the switching device, a user or an outer actuator moves the handle 80 from the first handle position H1 towards the second handle position H2 according to the rotation direction D1 (FIG. 4).

In response to the movement of the handle 80, the actuation element 81 couples with the activation lever 90 at the first coupling portion 901.

The actuation element 80 exerts a force on the activation lever 90, which in turn moves translationally with respect to the support element 611 from the first lever position P1 to the second lever position P2, according to the direction L1.

During such a translational movement, the activation lever 90 exerts a force on the trip shaft 70.

In response to the actuation by the activation lever 90, the trip shaft 70 rotationally moves from the first trip position T1 to the second trip position T2, according to the rotation direction D3.

In response to the movement of the trip shaft 70, the control mechanism 6 passes from a closing configuration to a tripping configuration (tripping manoeuvre of the switching device) and moves the mobile contact assembly 4 from the first contact position C1 to the second contact position C2, according to the rotation direction D5, thereby causing the separation of the electric contacts 31, 32.

It is evidenced how, thanks to the action of the activation lever 9 on the trip shaft 70, the electric contacts 31, 32 are separated well before the opening manoeuvre in progress is completed, i.e. well before the handle 80 has reached the handle position H2 upon the actuation by a user or an outer actuator.

The passage of the control mechanism 6 from a closing configuration to a tripping configuration causes the automatic movement of the handle 80 to the third handle position H3 and the movement of the support element 611 to the second control position S2.

The movement of the support element 611 causes the separation of the activation lever 90 from the actuation element 81 and from the trip shaft 70.

Thanks to the biasing action of the spring 91, the activation lever 90 performs a roto-translational movement with respect the support element 611 itself and reaches an uncoupling position with respect to the trip shaft 70.

The switching device 1 is now a tripping state.

It is evidenced that, differently from traditional switching devices, such a tripping state of the switching device 1 is achieved even if an opening manoeuvre is in progress.

In this situation (FIG. 5):

- the electric contacts 31, 32 are separated, the mobile contact assembly 4 is in the second contact position C2, the trip shaft 70 is in the second trip position T2, the activation lever is in the second lever position P2, the support element 611 is in the second control position S2 and the handle 80 is in the third handle position H3;
- the activation lever 90 is decoupled from the trip shaft 70;
- the spring 91 advantageously biases the end 90B to prevent undue rotations of the activation lever 90.

After the movement to the first trip position T1, the trip shaft 70 automatically returns in the first trip position T1 upon the actuation by an actuation member of the trip mechanism 7, such as for example a trip shaft spring (not shown) operatively coupled with the trip shaft 70.

Such an automatic return movement of the trip shaft 70 may occur immediately after the reaching of the second trip position T2 or in a subsequent instant (e.g. at the following closing manoeuvre) depending on the specific application of the switching device.

In order to complete the opening manoeuvre of the switching device 1, a user or an outer actuator moves the handle 80 from the third handle position H3 towards the second handle position H2 according to the rotation direction D1.

During such a movement of the handle 80, the support element 611 remains in the second control position S2.

The movement of the handle 80 from the third handle position H3 towards the second handle position H2 has substantially no influence on the activation lever 90 that remains stationery with respect to the trip shaft 70 in an uncoupling position with respect to this latter.

In response to the movement of handle 80 from the third handle position H3 towards the second handle position H2, the actuation mechanism 6 passes from a tripping configuration to an open configuration, thereby completing the opening manoeuvre of the switching device. However, this movement of the control mechanism 6 has no influence on the contact assembly 4, which remains in the contact position C2.

The switching device 1 is now in an opening state.

In this condition (FIG. 6):

- the electric contacts 31, 32 are separated, the mobile contact assembly 4 is in the second contact position C2, the activation lever 90 is in the second lever position P2, the support element 611 is in the second control position S2 and the handle 80 is in the second handle position H2;
- the activation lever 90 is decoupled from the trip shaft 70;
- the spring 91 advantageously biases the end 90B to maintain the activation lever 90 in proper position with respect to the trip shaft 70, thereby preventing undue rotations of the activation lever 90.

Figure 7:
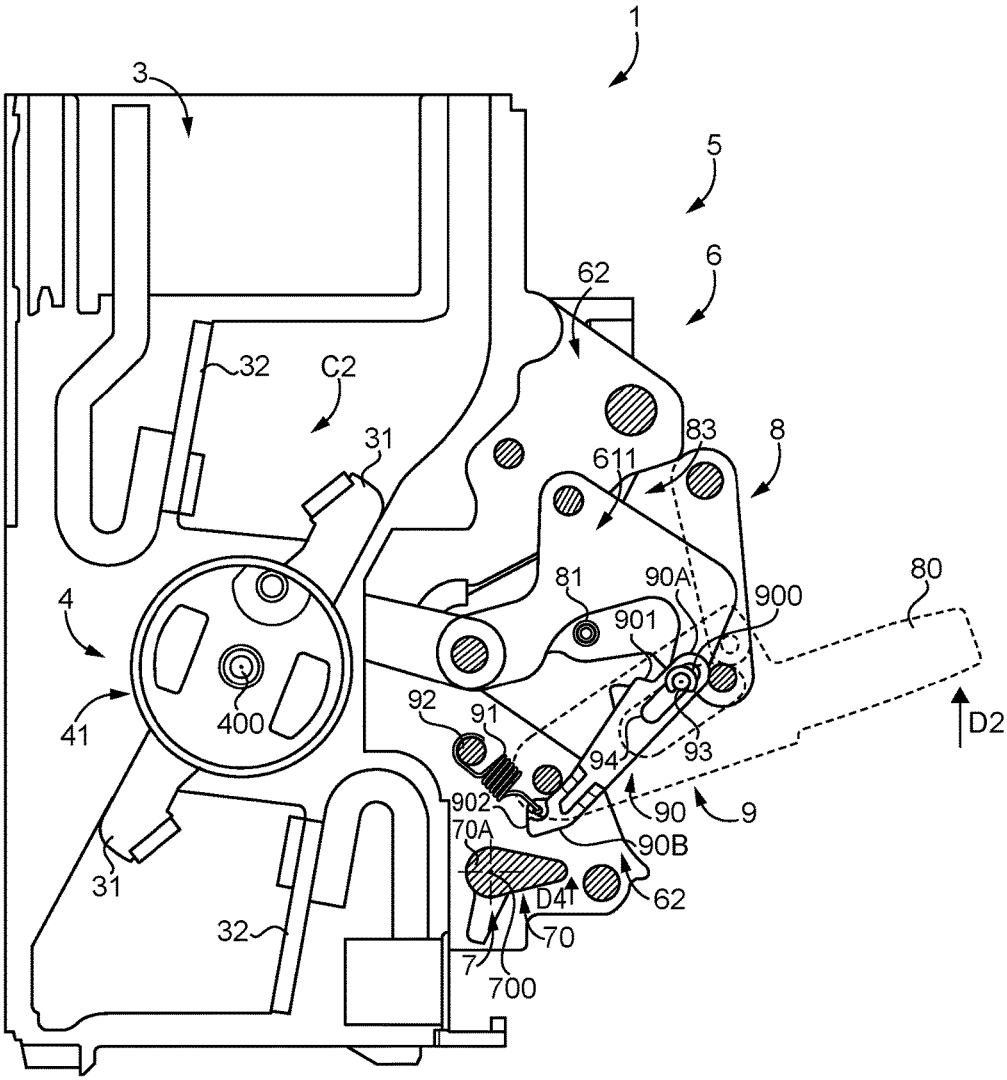
Figure 8:
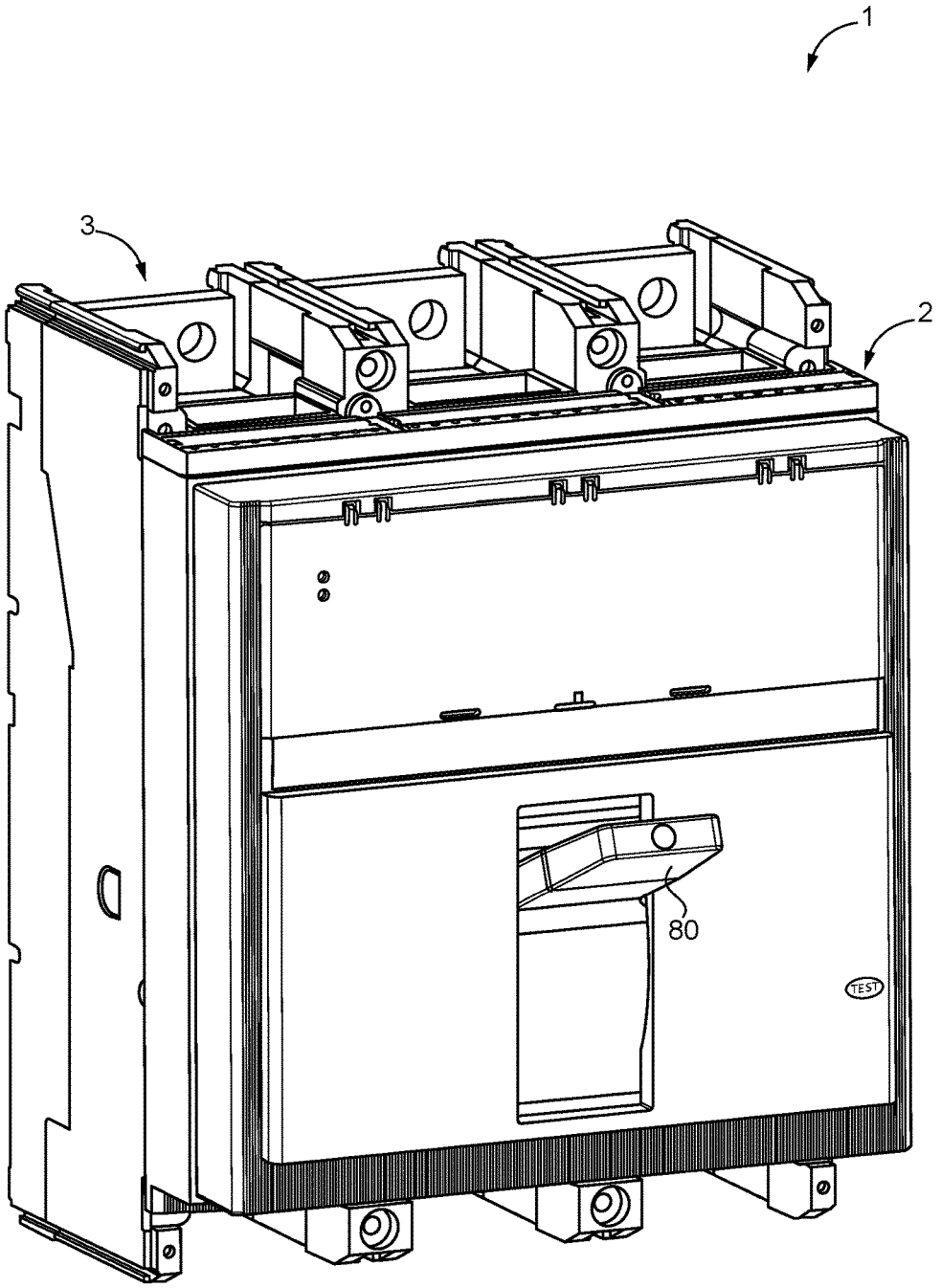
FIGS. 8-15 show a schematic view of a further embodiment of the switching device, according to the invention.
Figure 9:
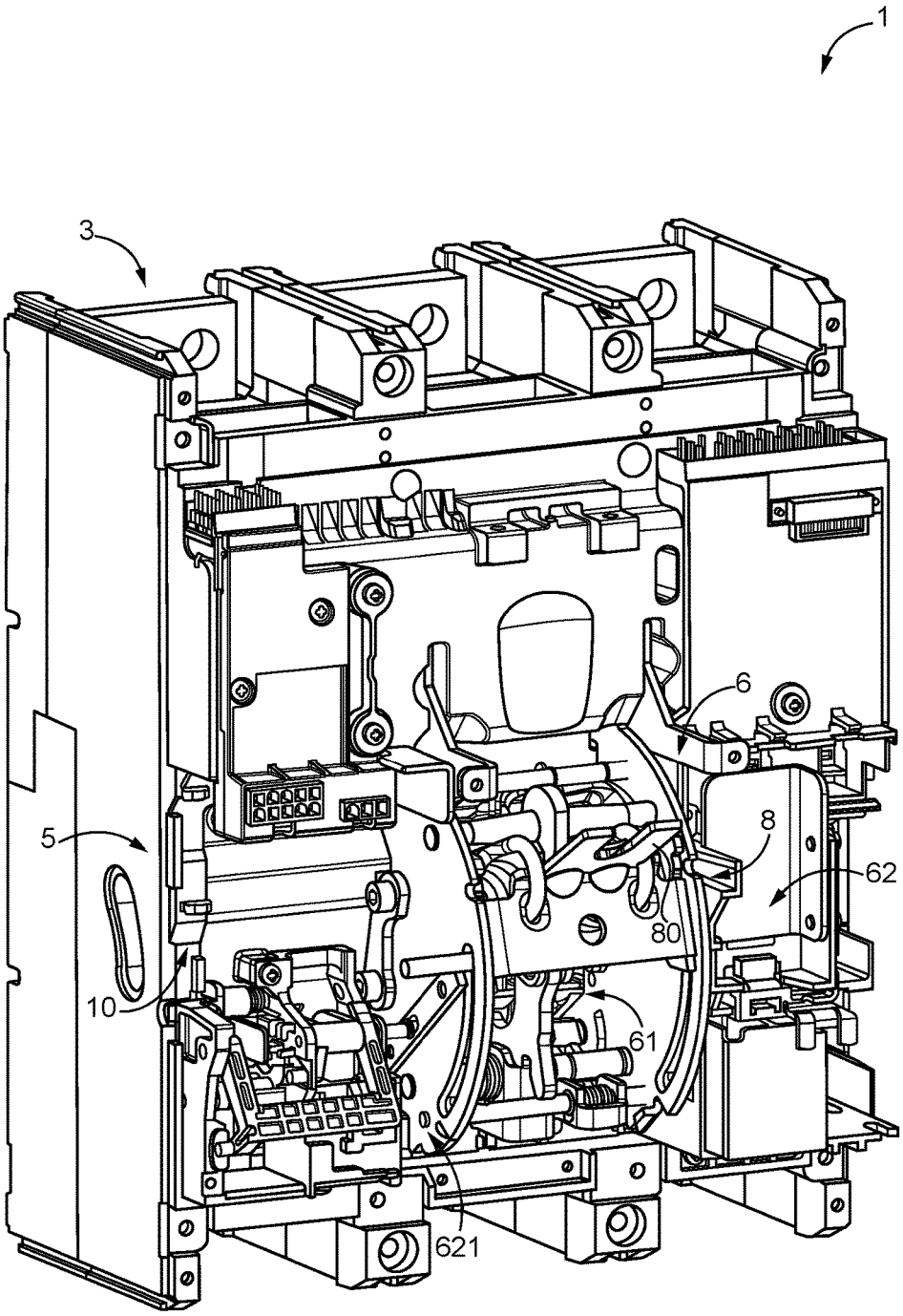
Figure 10:
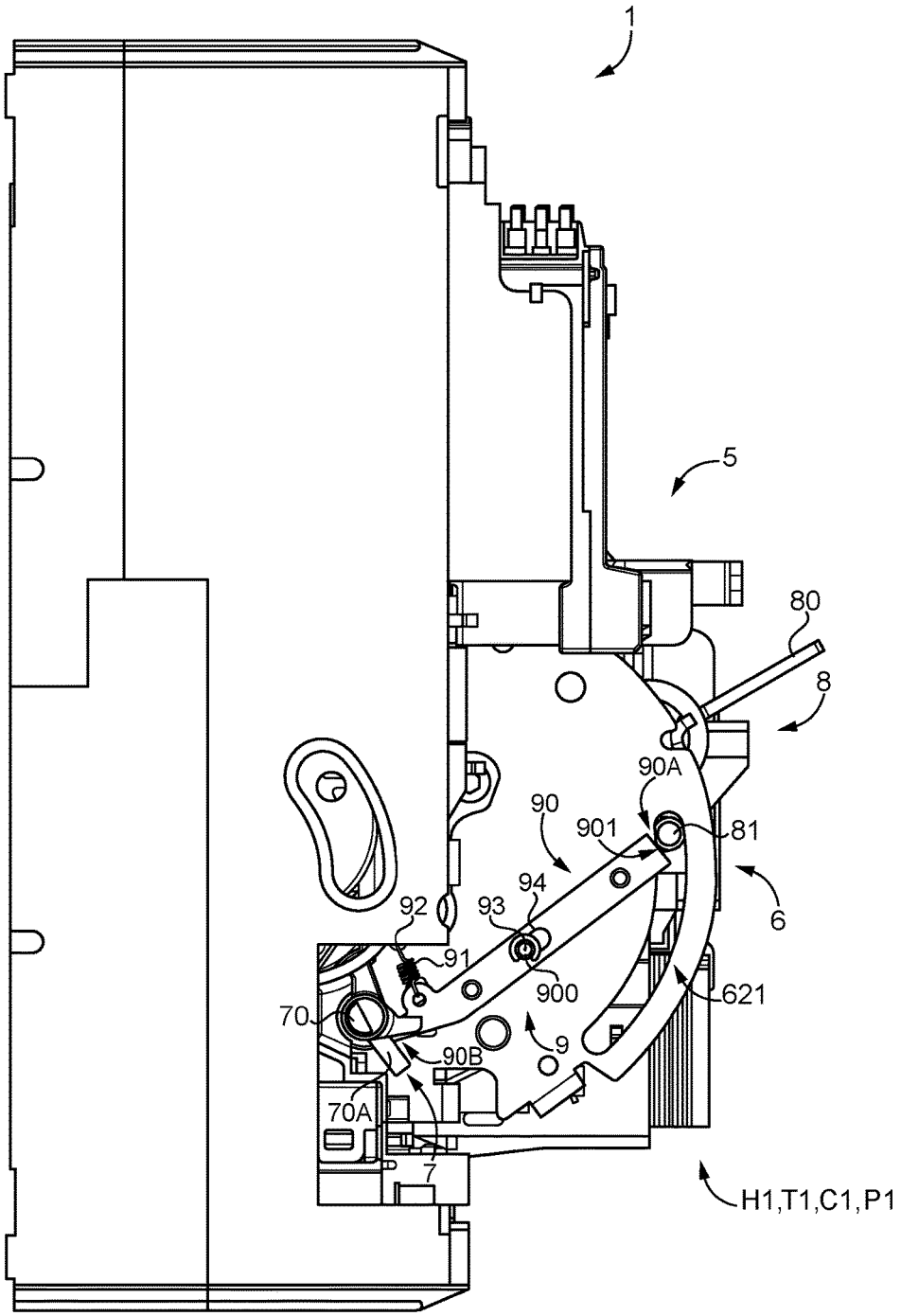

In order to perform a closing manoeuvre of the switching device 1, a user or an outer actuator moves the handle 80 from the second handle position H2 towards the first handle position H1 according to the rotation direction D2, opposite to the rotation direction D1 (FIG. 7).

In response to the movement of the handle 80, the control mechanism 6 passes from an open configuration to a closing configuration (closing manoeuvre of the switching device) and moves the mobile contact assembly 4 from the second contact position C2 to the first contact position C1, according to the rotation direction D6 opposite to the direction D5, thereby causing the coupling of the electric contacts 31, 32.

The passage of the control mechanism 6 from an open configuration to a closing configuration causes the movement of the support element 611 to the first control position S1. In response to the movement of the support element 611, thanks to the biasing action of the spring 91, the activation lever 90 moves roto-translationally with respect to the support element 611 itself and returns in the first lever position P1, at which it is coupled with the trip shaft 70 without exerting any force to move this latter.

The switching device 1 is now back to a closing state.

It is evidenced that the kinematic behaviour of the activation lever 90 is substantially the same during a normal tripping manoeuvre of the switching device caused by a protection device operatively associated with the switching device.

In this case, however, the actuation lever 90 does not transmit forces to the trip shaft 70 even if it is actuated by the actuation pin 81 in response to the automatic movement of the handle 80 from the first handle position H1 to the third handle position H3.

The trip shaft 70 is, in fact, actuated by the protection device.

Referring now to FIGS. 8-15, a further possible embodiment of the switching device 1, according to the invention, is now described in more details.

According the embodiment of FIGS. 8-15, the activation mechanism 9 comprises the activation lever 90, which has an elongated body having opposite first and second ends 90A, 90B.

The activation lever 90 is hinged (e.g. by means of a suitable connection pin) to a support element 621 at a hinging point 93.

According the embodiment of FIGS. 8-15, the support element 621 is fixed with respect to the outer casing 2.

As an example, the support element 621 may be a supporting frame member of the control mechanism 6, which is fixed to the outer casing 2.

The activation lever 90 is movable with respect to the support element 621 at the hinging point 93.

The activation lever 90 is configured to be reversibly movable in a translational way with respect to the support element 621.

To this aim, the activation lever 90 comprises the slot 94 along which the hinging point 93 slides when the activation lever 90 translationally moves with respect to the support element 611.

As shown in FIGS. 8-15, the slot 94 is advantageously at an intermediate position between the first and second ends 90A, 90B of the activation lever 90.

The activation lever 90 is configured to be rotationally movable with respect to the support element 621 at the hinging point 93 about the third rotation axis 900.

The activation lever 90 comprises a first coupling portion 901, at which it is coupleable with an actuation element 81.

As shown in FIGS. 8-15, the first coupling portion 901 is advantageously positioned at the first end 90A of the activation lever 90.

Advantageously, the activation lever 90 is coupleable with an actuation element 81 of the handle mechanism 8 at the first coupling portion 901, which can relatively move with respect to the activation lever 90 when the handle 80 moves.

As shown in FIGS. 8-15, the actuation element 81 may be an actuation pin arranged substantially parallel to the rotation axis 900 and protruding from one of the coupling members 83 of the handle mechanism 8.

Advantageously, the actuation pin 81 is arranged in such a way to slide along a slot 621A obtained in the support member 621, when it moves together with the handle 80.

The activation lever 90 comprises a second coupling portion 902, at which it is coupled with the trip shaft 70.

Preferably, at the second coupling portion 902, the activation lever 90 is coupleable with a protruding finger 70A of the trip shaft 70.

As it will better shown in the following description, the activation lever 90 is arranged to be permanently coupled with the trip shaft 70 at the second coupling portion 902.

As shown in FIGS. 8-15, the second coupling portion 902 is advantageously positioned at the second end 90B of the activation lever 90.

According to the embodiment of FIGS. 8-15, the actuation mechanism 9 comprises a spring 91 operatively connected with the activation lever 90 and a connection point 92 that is fixed with respect to the outer casing 2.

Advantageously, the spring 91 is coupled with the activation lever 90 in a distal position with respect to the first end 90A thereof, namely at the second end 90B.

In this way, the spring 91 may exert a biasing force to favour or contrast a rotation of the activation lever 90 with respect to the support element 611 about the rotation axis 900 at the hinging point 93.

The operation of the switching device 1 in the embodiment of FIGS. 8-15 is now disclosed in more details.

The switching device 1 is initially supposed to be in a closing state.

In this situation (FIG. 10):

- the electric contacts 31, 32 are coupled, the mobile contact assembly 4 is in the first contact position C1, the trip shaft 70 is in the first trip position T1, the activation lever is in a first lever position P1 and the handle 80 is in the first handle position H1;
- the actuation element 81 is coupled with the activation lever 90 without exerting any force on this latter;
- the activation lever 90 is coupled with the trip shaft 70 without exerting any force on this latter;
- the spring 91 advantageously biases the end 90B of the activation lever 90 to maintain this latter properly positioned with respect to the trip shaft 70, thereby preventing undue rotations of the activation lever 90.

Figure 11:
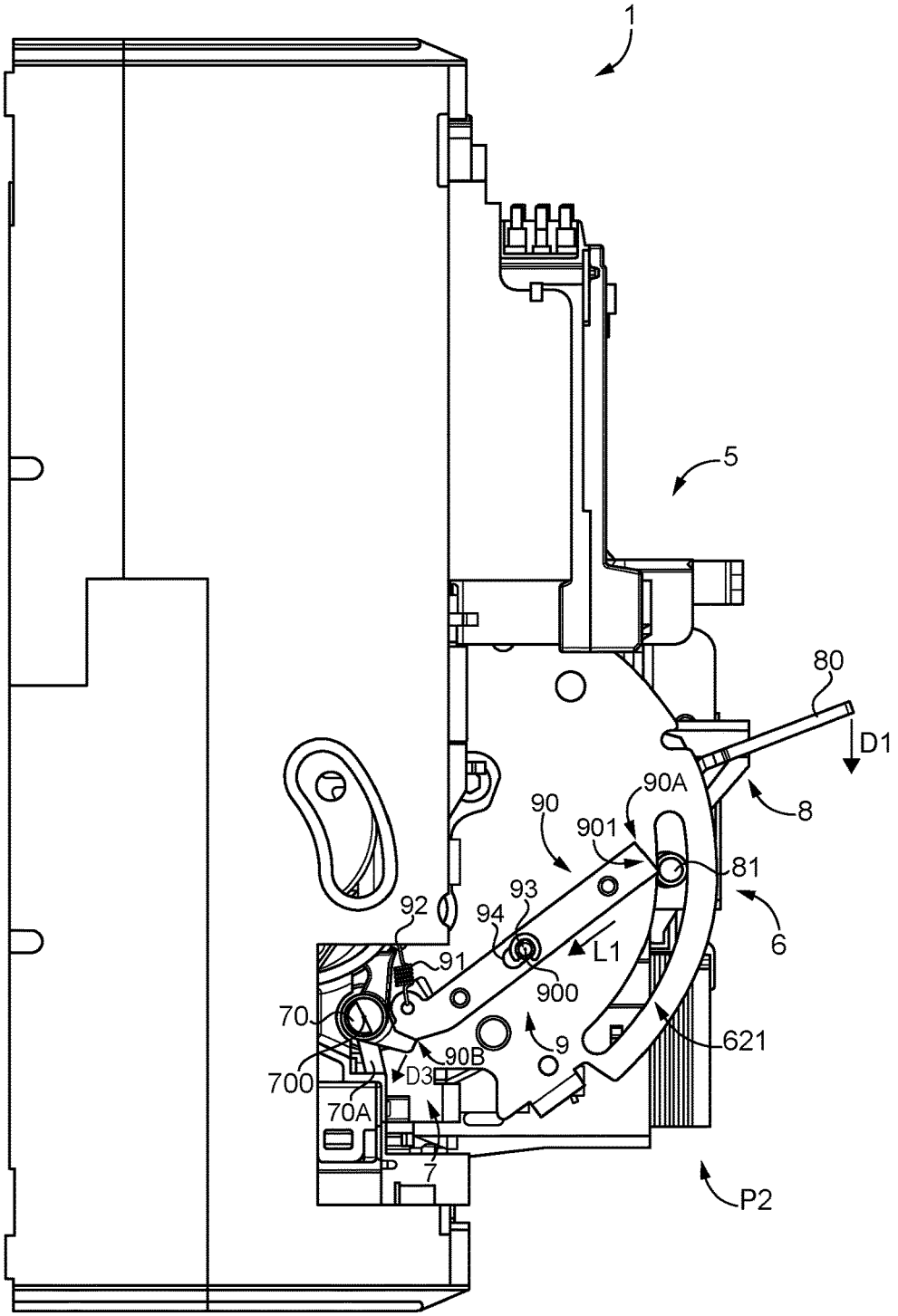
Figure 12:
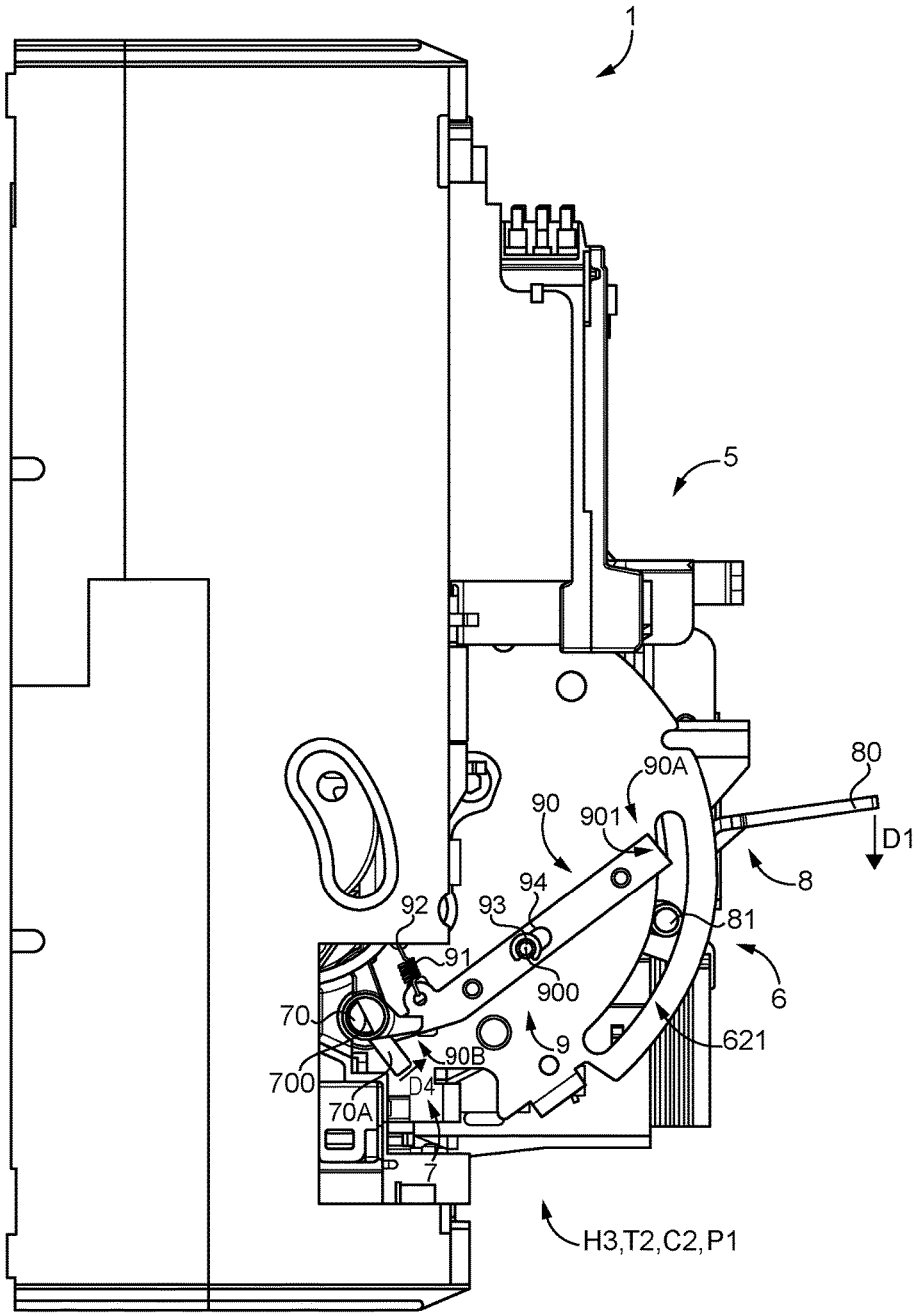

In order to perform an opening manoeuvre of the switching device 1, a user or an outer actuator moves the handle 80 from the first handle position H1 towards the second handle position H2 according to the rotation direction D1 (FIG. 11).

In response to the movement of the handle 80, the actuation element 81 exerts a force on the activation lever 90, which in turn moves translationally with respect to the support element 611 from the first lever position P1 to a second lever position P2, according to the direction L1.

During such a translational movement, the activation lever 90 exerts a force on the trip shaft 70.

In response to the actuation by the activation lever 90, the trip shaft 70 rotationally moves from the first trip position T1 to the second trip position T2, according to the rotation direction D3.

In response to the movement of the trip shaft 70, the control mechanism 6 passes from a closing configuration to a tripping configuration (tripping manoeuvre of the switching device) and moves the mobile contact assembly 4 from the first contact position C1 to the second contact position C2, thereby causing the separation of the electric contacts 31, 32.

Again, the electric contacts 31, 32 are separated well before the opening manoeuvre in progress is completed, i.e. well before the handle 80 has reached the handle position H2 upon the actuation by a user or an outer actuator.

The passage of the control mechanism 6 from a closing configuration to a tripping configuration causes the automatic movement of the handle 80 to the third handle position H3.

Such a movement of the handle 80 causes the uncoupling of the actuation element 81 from the activation lever 90.

The switching device 1 is now a tripping state.

Again, such a tripping state of the switching device 1 is achieved even if an opening manoeuvre is in progress.

In this situation (FIG. 12):

the electric contacts 31, 32 are separated, the mobile contact assembly 4 is in the second contact position C2, the trip shaft 70 is in the second trip position T2 and the handle 80 is in the third handle position H3;

the activation lever 90 is coupled with the trip shaft 70;

the spring 91 advantageously biases the end 90B to prevent undue rotations of the activation lever 90.

After the movement to the second trip position T2, the trip shaft 70 automatically returns in the first trip position T1 upon the actuation by an actuation member of the trip mechanism 7, such as for example a trip shaft spring (not shown) operatively coupled with the trip shaft 70. Such an automatic return movement of the trip shaft 70 may occur immediately after the reaching of the second trip position T2 as it may be seen from FIGS. 10-12.

Figure 13:
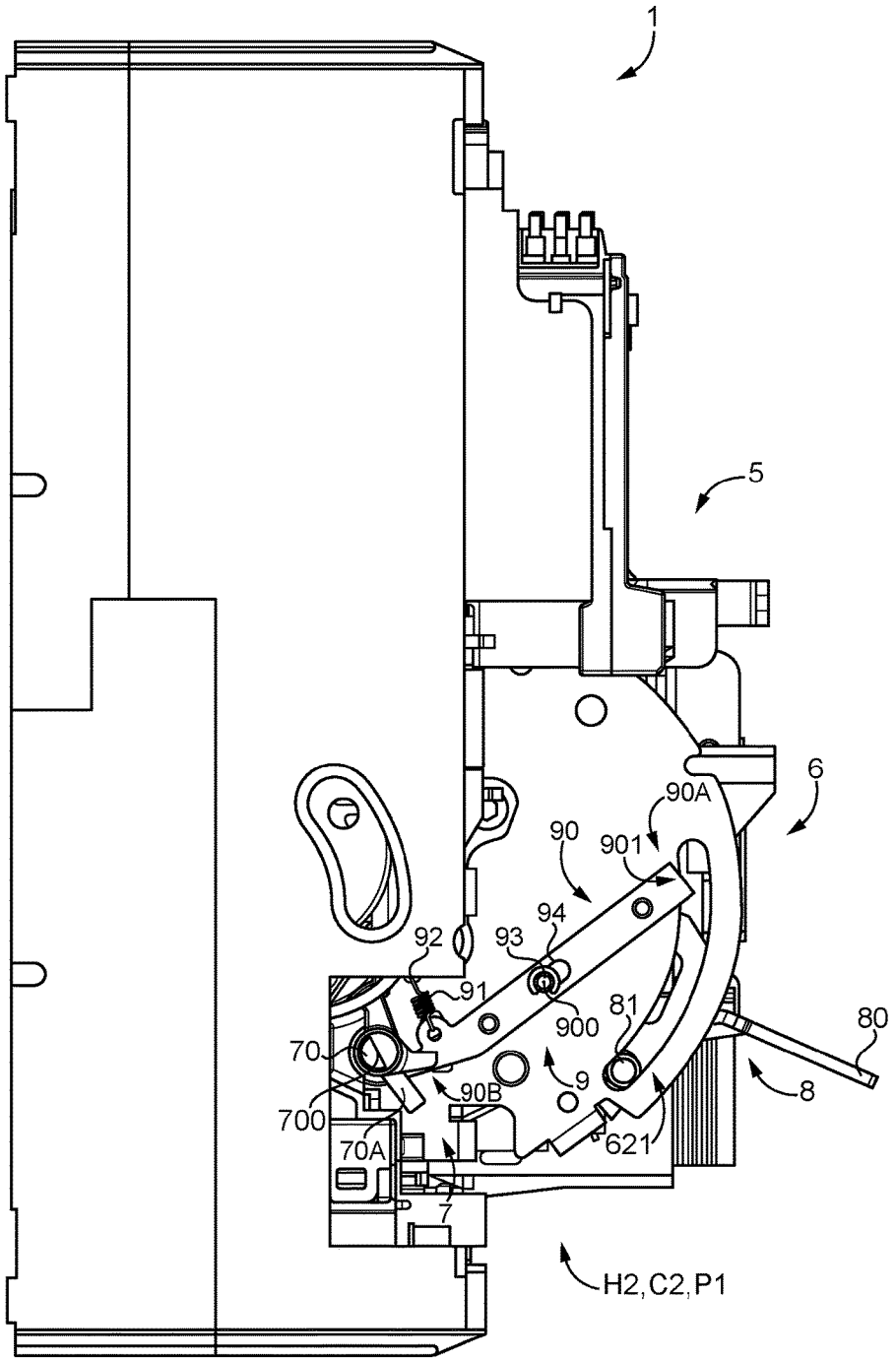

However, other solutions are possible depending on the specific application of the switching device As the activation lever 90 is constantly coupled with the trip shaft 70 at the second coupling portion 902, during such an automatic movement, the trip shaft 70 exerts a force of the activation lever 90 that returns (with a translational movement opposite to the movement L1 with respect to the support 621) in the first lever position P1 (FIG. 13).

Such an automatic translational return movement of the activation lever 90 is made possible by the fact that the actuation element 81 is no more coupled with the activation lever 90 as the handle 80 has been automatically moved to the third handle position H3.

In order to complete the opening manoeuvre of the switching device 1, a user or an outer actuator moves the handle 80 from the third handle position H3 towards the second handle position H2 according to the rotation direction D1.

As the actuation element 81 is uncoupled with the activation lever 90, the movement of the handle 80 from the third handle position H3 towards the second handle position H2 has substantially no influence on the activation lever 90 that remains stationery with respect to the trip shaft 70.

In response to the movement of handle 80 from the third handle position H3 towards the second handle position H2, the actuation mechanism 6 passes from a tripping configuration to an open configuration, thereby completing the opening manoeuvre of the switching device. However, this movement of the control mechanism 6 has no influence on the contact assembly 4, which remains in the contact position C2.

The switching device 1 is now in an opening state.

In this condition (FIG. 13):

the electric contacts 31, 32 are separated, the mobile contact assembly 4 is in the second contact position C2, the activation lever 90 is in the first lever position P1 and the handle 80 is in the second handle position H2;

the spring 91 advantageously biases the end 90B to maintain the activation lever 90 in proper position with respect to the trip shaft 70, thereby preventing undue rotations of the activation lever 90.

Figure 14:
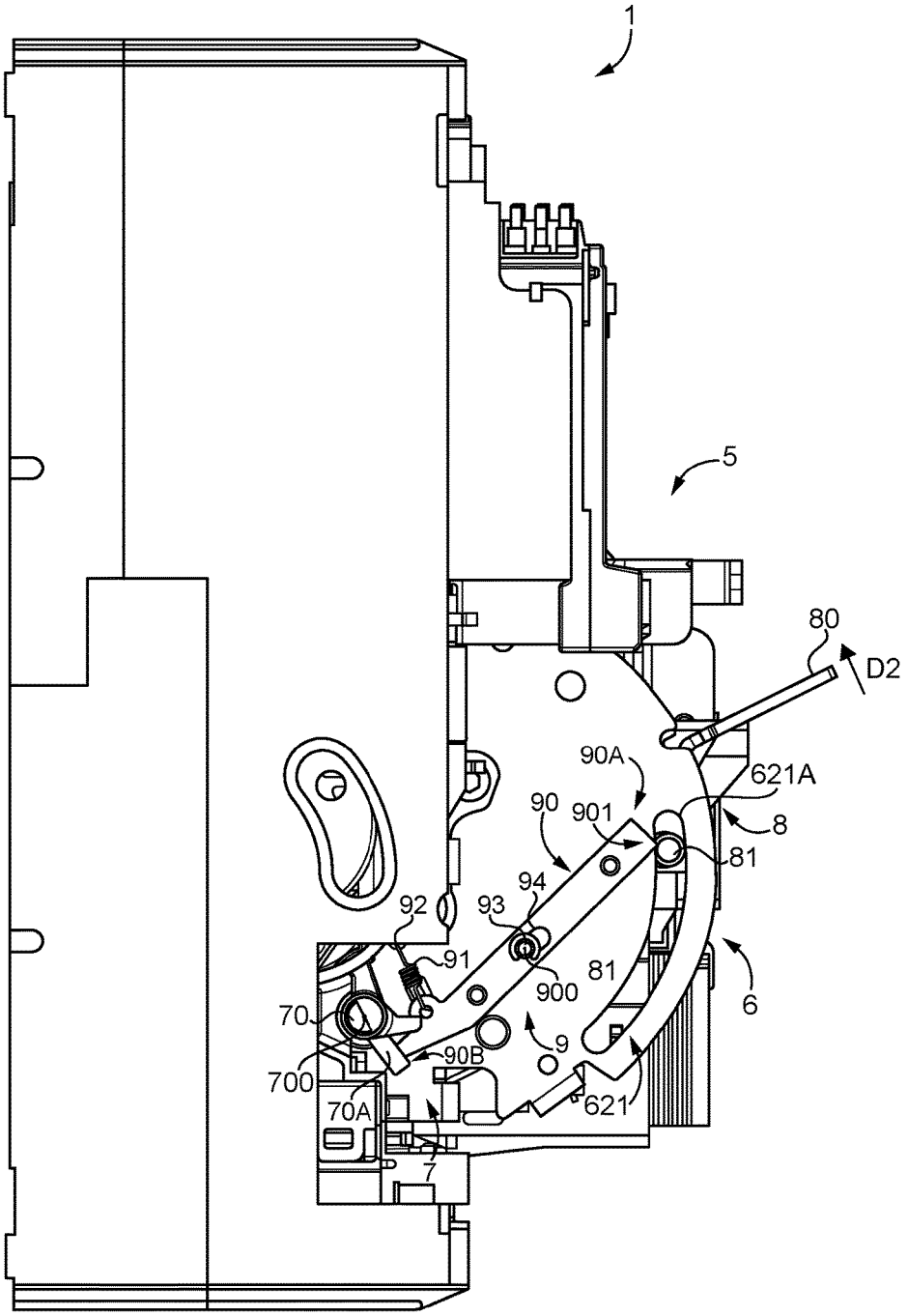
Figure 15:
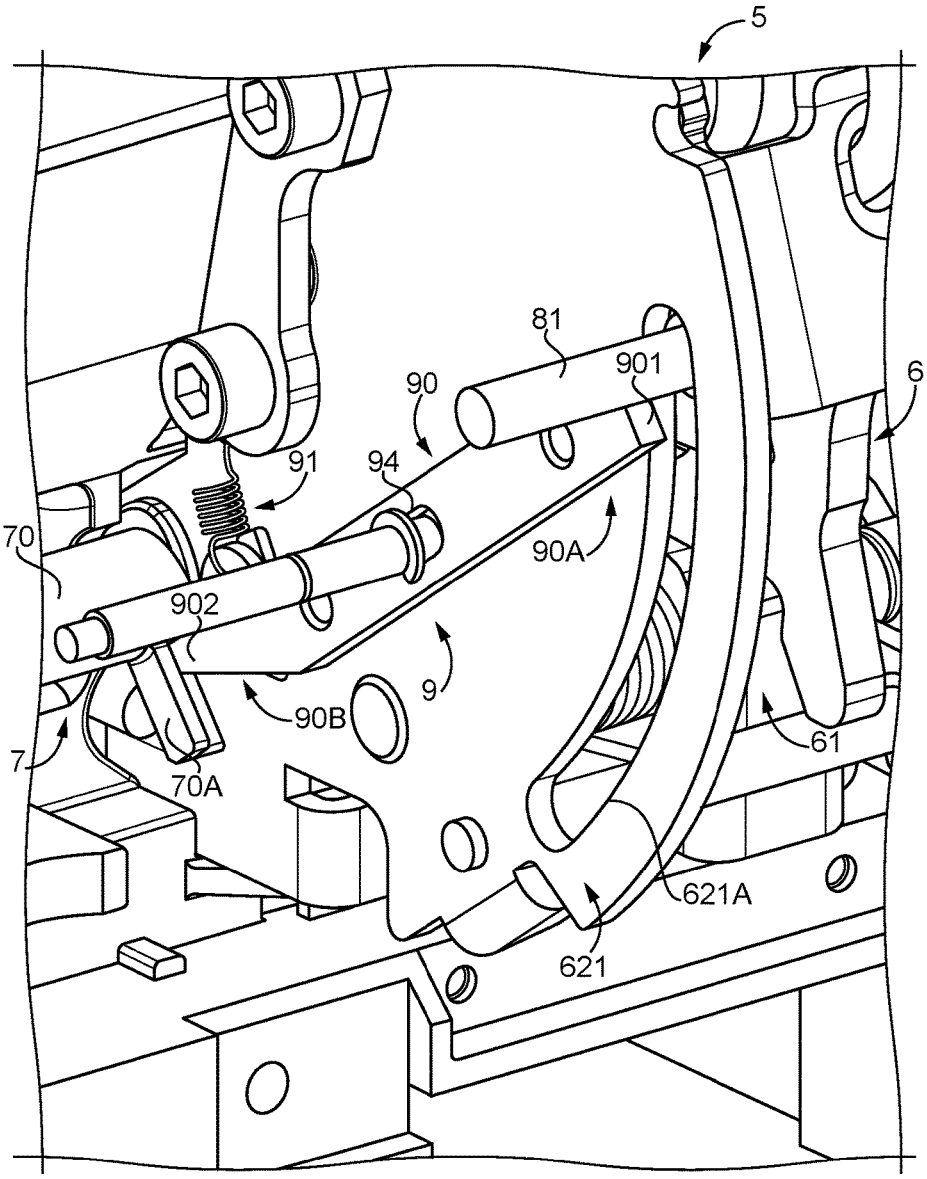

In order to perform a closing manoeuvre of the switching device 1, a user or an outer actuator moves the handle 80 from the second handle position H2 towards the first handle position H1 according to the rotation direction D2, opposite to the rotation direction D1 (FIG. 14).

During the movement of the handle 80 towards the first handle position H1, the actuation element 81 comes again in contact with the activation lever 90 (which has returned in the first lever position P1) and exerts a force on this latter.

As the activation lever 90 is rotationally movable with respect to the support element 621, the force exerted by the actuation element 81 causes a rotation of the activation lever 90 about the rotation axis 900 according to the rotation direction R1.

Such a movement of the activation lever 90 is opposed by the biasing force exerted by the spring 91 on the activation lever 90 at the second end 90B.

As soon as the handle 80 has reached the first handle position H1 and the actuation element 81 has returned in its initial position with the switching device 1 in the closing state, the activation lever 90 returns again (with a rotational movement opposite to the movement R1 with respect to the support 621) in the first lever position P1.

Such a return movement of the activation lever is made possible by the biasing action of the spring 91 on the second end 90B of the activation lever 90.

In response to the movement of the handle 80, the control mechanism 6 passes from an open configuration to a closing configuration (closing manoeuvre of the switching device) and moves the mobile contact assembly 4 from the second contact position C2 to the first contact position C1, thereby causing the coupling of the electric contacts 31, 32.

The switching device 1 is now back to a closing state.

It is evidenced that the kinematic behaviour of the activation lever 90 is substantially the same during a normal tripping manoeuvre of the switching device caused by a protection device operatively associated with the switching device.

In this case, however, the actuation lever 90 does not transmit forces to the trip shaft 70 even if it is actuated by the actuation pin 81 in response to the automatic movement of the handle 80 from the first handle position H1 to the third handle position H3.

The trip shaft 70 is, in fact, actuated by the protection device.

The switching device 1, according to the invention, allows achieving the intended aims and objects.

In the switching device 1, thanks to the arrangement of the activation mechanism 9, the separation of the electric contacts 31, 32 is basically caused by the intervention of the trip mechanism 7 (in particular of the trip shaft 70) even if an opening manoeuvre is performed by operating the handle mechanism 8 (in particular the handle 80).

A very short time, which has been calculated as being approximately 50% shorter than in traditional switching devices, is therefore required for separating the electric contacts during an opening manoeuvre performed by a user on an outer actuator.

This fact entails relevant advantages for the operating life of the switching device, as it allows remarkably reducing the raising of wear phenomena at the electric contacts with consequent reduction of the need for maintenance interventions.

The switching device, according to the invention, is therefore characterized by lower overall operating costs with respect to currently available switching devices of the traditional type.

The activation mechanism 9 has the remarkable advantage of being easy to integrate with the other mechanisms of the mechanical control assembly 5.

The switching device 1 therefore shows a compact structure easy to manufacture and assembly at industrial level.

The activation mechanism 9 may be easily mounted in a modular manner with respect to the other mechanisms of the mechanical control assembly 5. In this case, it may be easily removed or substituted in case of need.

As the separation of the electric contacts 31-32, during an opening manoeuvre performed by operating the handle mechanism 8, is basically due to the intervention of the trip mechanism 7, the switching device 1 substantially shows a different operating behavior with respect to the currently available switching devices.

This fact favors the development and implementation of different and improved strategies for managing the operating life of an electric installation in which the switching device 1 is integrated.

The invention claimed is:

1. A switching device for LV electric installations comprising:

one or more electric poles, each electric pole comprising one or more mobile contacts and one or more fixed contacts adapted to be coupled or uncoupled;

a mobile contact assembly comprising said mobile contacts and reversibly movable between a first contact position, at which said movable contacts and said fixed contacts are coupled, and a second contact position, at which said movable contacts and said fixed contacts are uncoupled;

a mechanical control assembly for operating said mobile contact assembly, said mechanical control assembly comprising:

a control mechanism for reversibly moving said mobile contact assembly between said first and second contact positions;

a trip mechanism operatively coupled with said control mechanism, said trip mechanism comprising a trip shaft reversibly movable between a first trip position and a second trip position, said control mechanism being adapted to move said mobile contact assembly from said first contact position to said second contact position in response to a movement of said trip shaft from said first trip position to said second trip position;

a handle mechanism operatively coupled with said control mechanism, said handle mechanism comprising a handle adapted to be reversibly moved by a user or an outer actuator between a first handle position and a second handle position, said control mechanism being adapted to move said mobile contact assembly from said first contact position to said second contact position in response to a movement of said handle from said first handle position to said second handle position and to move said mobile contact assembly from said second contact position to said first contact position in response to a movement of said handle from said second handle position to said first handle position;

wherein said mechanical control assembly comprises an activation mechanism adapted to operatively couple said handle mechanism with said trip mechanism to actuate said trip shaft during an opening manoeuvre of said switching device;

wherein said activation mechanism is adapted to move said trip shaft from said first trip position to said second trip position in response to a movement of said handle from said first handle position towards said second handle position upon an actuation by a user or an outer actuator;

wherein said activation mechanism comprises an activation lever hinged to a support element and movable with respect to said support element;

wherein said activation lever is translationally and rotationally movable with respect to said support element; and wherein said activation lever is actuated by said handle mechanism during a movement of said handle from said first handle position to said second handle position upon the actuation by the user or the outer actuator, said activation lever moving translationally with respect to said support element from a first lever position to a second lever position and transmitting a force to said trip shaft to move said trip shaft from said first trip position to said second trip position in response to the actuation by said handle mechanism.

2. The switching device, according to claim 1, wherein said activation mechanism is adapted to be actuated by said handle mechanism and transmit a force to said trip shaft to move said trip shaft from said first trip position to said second trip position in response to a movement of said handle from said first handle position towards said second handle position upon the actuation by the user or the outer actuator.

3. The switching device, according to claim 2, wherein said activation mechanism comprises an activation lever hinged to a support element and movable with respect to said support element.

4. The switching device, according to claim 1, wherein said activation mechanism comprises an elastic element operatively connected with said activation lever and a connection point that is fixed with respect to said outer casing.

5. The switching device, according to claim 1, wherein said support element is fixed with respect to an outer casing of said switching device.

6. The switching device, according to claim 5, wherein said activation lever is adapted to be actuated by said trip shaft to return in said first lever position during a movement of said trip shaft from said second trip position to said first trip position.

7. The switching device, according to claim 5 wherein said activation lever is adapted to be actuated by said handle mechanism and rotationally move with respect to said support element during a movement of said handle from said second handle position to said first handle position.

8. The switching device, according claim 1, wherein said support element is movable with respect to an outer casing of said switching device.

9. The switching device, according to claim 8, wherein said activation lever is adapted to be actuated by said support element to return in said first lever position during a movement of said handle from said second handle position to said first handle position.

10. The switching device, according to claim 9, wherein said activation lever is adapted to remain uncoupled from said handle mechanism during a movement of said handle from said second handle position to said first handle position.

11. The switching device, according to claim 8 wherein said activation lever is adapted to remain uncoupled from said handle mechanism during a movement of said handle from said second handle position to said first handle position.

12. A switching device for LV electric installations comprising:

one or more electric poles, each electric pole comprising one or more mobile contacts and one or more fixed contacts adapted to be coupled or uncoupled;

a mobile contact assembly comprising said mobile contacts and reversibly movable between a first contact position, at which said movable contacts and said fixed contacts are coupled, and a second contact position, at which said movable contacts and said fixed contacts are uncoupled;

a mechanical control assembly for operating said mobile contact assembly, said mechanical control assembly comprising:

a control mechanism for reversibly moving said mobile contact assembly between said first and second contact positions;

a trip mechanism operatively coupled with said control mechanism, said trip mechanism comprising a trip shaft reversibly movable between a first trip position and a second trip position, said control mechanism being adapted to move said mobile contact assembly from said first contact position to said second contact position in response to a movement of said trip shaft from said first trip position to said second trip position;

a handle mechanism operatively coupled with said control mechanism, said handle mechanism comprising a handle adapted to be reversibly moved by a user or an outer actuator between a first handle position and a second handle position, said control mechanism being adapted to move said mobile contact assembly from said first contact position to said second contact position in response to a movement of said handle from said first handle position to said second handle position and to move said mobile contact assembly from said second contact position to said first contact position in response to a movement of said handle from said second handle position to said first handle position;

wherein said mechanical control assembly comprises an activation mechanism adapted to operatively couple said handle mechanism with said trip mechanism to actuate said trip shaft during an opening manoeuvre of said switching device;

wherein said activation mechanism is adapted to move said trip shaft from said first trip position to said second trip position in response to a movement of said handle from said first handle position towards said second handle position upon an actuation by a user or an outer actuator;

wherein said activation mechanism comprises an activation lever hinged to a support element and movable with respect to said support element; and wherein said activation mechanism comprises an elastic element operatively connected with said activation lever and a connection point that is fixed with respect to said outer casing.

13. A switching device for LV electric installations comprising:

one or more electric poles, each electric pole comprising one or more mobile contacts and one or more fixed contacts adapted to be coupled or uncoupled;

a mobile contact assembly comprising said mobile contacts and reversibly movable between a first contact position, at which said movable contacts and said fixed contacts are coupled, and a second contact position, at which said movable contacts and said fixed contacts are uncoupled;

a mechanical control assembly for operating said mobile contact assembly, said mechanical control assembly comprising:

a control mechanism for reversibly moving said mobile contact assembly between said first and second contact positions;

a trip mechanism operatively coupled with said control mechanism, said trip mechanism comprising a trip shaft reversibly movable between a first trip position and a second trip position, said control mechanism being adapted to move said mobile contact assembly from said first contact position to said second contact position in response to a movement of said trip shaft from said first trip position to said second trip position;

a handle mechanism operatively coupled with said control mechanism, said handle mechanism comprising a handle adapted to be reversibly moved by a user or an outer actuator between a first handle position and a second handle position, said control mechanism being adapted to move said mobile contact assembly from said first contact position to said second contact position in response to a movement of said handle from said first handle position to said second handle position and to move said mobile contact assembly from said second contact position to said first contact position in response to a movement of said handle from said second handle position to said first handle position;

wherein said mechanical control assembly comprises an activation mechanism adapted to operatively couple said handle mechanism with said trip mechanism to actuate said trip shaft during an opening manoeuvre of said switching device;

wherein said activation mechanism is adapted to move said trip shaft from said first trip position to said second trip position in response to a movement of said handle from said first handle position towards said second handle position upon an actuation by a user or an outer actuator;

wherein said activation mechanism comprises an activation lever hinged to a support element and movable with respect to said support element;

wherein said support element is movable with respect to an outer casing of said switching device; and wherein said activation lever is adapted to be actuated by said support element to return in said first lever position during a movement of said handle from said second handle position to said first handle position.

* * * * *